US006752330B2

(12) United States Patent
DiMaggio et al.

(10) Patent No.: US 6,752,330 B2
(45) Date of Patent: Jun. 22, 2004

(54) LIQUID SPRAYERS

(75) Inventors: Phillip Joseph DiMaggio, Kansas City, MO (US); Robert James Good, Lee's Summit, MO (US); Joseph Rae Krestine, Leawood, KS (US); Michael Joseph Murray, Batavia, OH (US); Alen David Streutker, Florence, KY (US)

(73) Assignee: The Procter & Gamble Company, Cincinnati, OH (US)

( * ) Notice: Subject to any disclaimer, the term of this patent is extended or adjusted under 35 U.S.C. 154(b) by 293 days.

(21) Appl. No.: 09/911,335

(22) Filed: Jul. 23, 2001

(65) Prior Publication Data

US 2002/0011531 A1 Jan. 31, 2002

Related U.S. Application Data

(63) Continuation-in-part of application No. 09/638,483, filed on Aug. 14, 2000, now Pat. No. 6,502,766, which is a continuation-in-part of application No. 09/624,061, filed on Jul. 24, 2000, now abandoned.

(51) Int. Cl.[7] ..... B05B 7/32; B05B 9/04; F32D 11/24; F32D 14/28; F32D 14/34

(52) U.S. Cl. ..... 239/337; 239/332; 239/333

(58) Field of Search ..... 239/337, 332, 239/333, 331, 329, 340, 347, 348, 349, 354, 526; 222/212, 214; 251/9

(56) References Cited

U.S. PATENT DOCUMENTS 2,117,747 A 5/1938 Smith et al.
D125,635 S 3/1941 Karstadt
3,122,324 A * 2/1964 Lee ..... 239/318
3,137,326 A 6/1964 Welty et al.
3,173,584 A 3/1965 Giavasis (List continued on next page.)

FOREIGN PATENT DOCUMENTS

DE 38 36290 A1 4/1990
DE G 89 12 705.6 4/1991

(List continued on next page.)

OTHER PUBLICATIONS

1278229 Diaphragm Pumps, Electric Systems AG, Apr. 19, 1971—National Reference Libray of Science and Inventors, Div. F1, p. 369.

(List continued on next page.)

*Primary Examiner*—Michael Mar
*Assistant Examiner*—Darren Gorman
(74) *Attorney, Agent, or Firm*—Thibault Fayette; Kim William Zerby; Steven W. Miller

(57) ABSTRACT

A liquid sprayer is provided. This liquid sprayer includes a bottle having an opening and a sprayer housing attached to the bottle. This sprayer housing includes an electrical motor, a voltage source for powering the electrical motor, a pump driven by the motor, a switch for completing an electrical circuit, a nozzle mechanism attached to the sprayer housing for spraying a liquid. The liquid sprayer also includes a deformable "pinched tube" mechanism which prevents liquid from flowing through the nozzle when the sprayer is not being used. The sprayer housing also includes a trigger movably connected to the sprayer housing for closing the switch, translating the piston and creating a leak-tight seal by squeezing the "pinched tube".

17 Claims, 16 Drawing Sheets

U.S. PATENT DOCUMENTS

| | | | | | |
|---|---|---|---|---|---|
| 3,462,082 | A | | 8/1969 | Everett | |
| 3,490,656 | A | | 1/1970 | Taschner | |
| 3,565,344 | A | | 2/1971 | Takei et al. | |
| 3,667,655 | A | | 6/1972 | Knieriem, Jr. | |
| 3,758,039 | A | * | 9/1973 | Wagner | 239/372 |
| 3,768,734 | A | | 10/1973 | Anderson, Jr. et al. | |
| 3,901,449 | A | | 8/1975 | Bochmann | |
| 3,904,116 | A | | 9/1975 | Jones et al. | |
| 3,986,644 | A | | 10/1976 | Grogan et al. | |
| 3,993,250 | A | | 11/1976 | Shure | |
| D244,991 | S | | 7/1977 | Weekman et al. | |
| 4,060,182 | A | | 11/1977 | Kikuchi | |
| 4,072,252 | A | | 2/1978 | Steyns et al. | |
| 4,153,203 | A | | 5/1979 | Tada | |
| 4,154,375 | A | | 5/1979 | Bippus | |
| 4,160,525 | A | | 7/1979 | Wagner | |
| 4,162,037 | A | | 7/1979 | Koyama | |
| 4,187,959 | A | | 2/1980 | Pelton | |
| 4,189,098 | A | | 2/1980 | Wagner et al. | |
| 4,220,285 | A | | 9/1980 | Gualdi | |
| 4,222,525 | A | | 9/1980 | Hildebrandt | |
| D258,800 | S | | 4/1981 | Halbeisen et al. | |
| 4,286,755 | A | * | 9/1981 | Shipman | 239/530 |
| 4,361,256 | A | | 11/1982 | Corsette | |
| 4,434,917 | A | | 3/1984 | Saito et al. | |
| 4,454,965 | A | | 6/1984 | Kirk, Jr. | |
| 4,519,518 | A | | 5/1985 | Wiles et al. | |
| 4,527,741 | A | | 7/1985 | Garneau | |
| 4,618,077 | A | | 10/1986 | Corsette | |
| 4,618,099 | A | | 10/1986 | Nagao et al. | |
| 4,621,770 | A | | 11/1986 | Sayen | |
| 4,767,033 | A | | 8/1988 | Gemperle | |
| 4,790,454 | A | | 12/1988 | Clark et al. | |
| 4,819,835 | A | | 4/1989 | Tasaki | |
| 4,830,235 | A | | 5/1989 | Miller | |
| 4,854,480 | A | * | 8/1989 | Shindo | 222/79 |
| 4,911,361 | A | | 3/1990 | Tada | |
| 4,925,105 | A | | 5/1990 | Lin | |
| 4,940,186 | A | | 7/1990 | Tada | |
| 4,953,791 | A | | 9/1990 | Tada | |
| 4,958,754 | A | | 9/1990 | Dennis | |
| 5,014,884 | A | | 5/1991 | Wunsch | |
| 5,147,074 | A | | 9/1992 | Battegazzore | |
| 5,150,841 | A | | 9/1992 | Silvenis et al. | |
| 5,195,664 | A | | 3/1993 | Rhea | |
| 5,215,227 | A | | 6/1993 | Farner | |
| 5,238,152 | A | | 8/1993 | Maas et al. | |
| 5,244,126 | A | | 9/1993 | Geier | |
| 5,257,724 | A | | 11/1993 | Steijns | |
| D343,577 | S | | 1/1994 | Proctor | |
| 5,297,701 | A | | 3/1994 | Steijns et al. | |
| 5,310,089 | A | | 5/1994 | Hudgins | |
| D351,646 | S | | 10/1994 | Foster et al. | |
| 5,395,051 | A | | 3/1995 | Anderson et al. | |
| 5,397,034 | A | | 3/1995 | Wunsch | |
| 5,467,900 | A | | 11/1995 | Maas et al. | |
| 5,472,119 | A | | 12/1995 | Park et al. | |
| 5,509,608 | A | | 4/1996 | Foster et al. | |
| 5,586,688 | A | | 12/1996 | Johnson et al. | |
| 5,605,496 | A | * | 2/1997 | Pickard | 451/90 |
| 5,645,221 | A | | 7/1997 | Foster | |
| 5,647,539 | A | | 7/1997 | Dobbs et al. | |
| 5,667,142 | A | * | 9/1997 | Newman | 239/346 |
| 5,704,521 | A | | 1/1998 | Grogan et al. | |
| 5,706,984 | A | | 1/1998 | Tada et al. | |
| 5,711,461 | A | | 1/1998 | Foster et al. | |
| 5,715,974 | A | | 2/1998 | Foster et al. | |
| 5,716,007 | A | | 2/1998 | Nottingham et al. | |
| 5,716,008 | A | | 2/1998 | Nottingham et al. | |
| RE35,744 | E | | 3/1998 | Foster et al. | |
| 5,725,132 | A | | 3/1998 | Foster et al. | |
| 5,752,629 | A | | 5/1998 | Hardy | |
| 5,806,724 | A | | 9/1998 | Foster | |
| 5,810,209 | A | | 9/1998 | Foster | |
| 5,845,798 | A | | 12/1998 | Carrier | |
| 5,845,820 | A | | 12/1998 | Foster | |
| D405,008 | S | | 2/1999 | Irwin et al. | |
| D406,052 | S | | 2/1999 | Dunmont et al. | |
| D406,060 | S | | 2/1999 | Dunmont et al. | |
| 5,865,344 | A | * | 2/1999 | Nagel | 222/79 |
| 5,884,845 | A | | 3/1999 | Nelson | |
| 5,928,594 | A | | 7/1999 | Foster | |
| 5,938,082 | A | | 8/1999 | Foster et al. | |
| D418,404 | S | | 1/2000 | Irwin et al. | |
| D420,914 | S | | 2/2000 | Cummings | |
| D421,388 | S | | 3/2000 | Cummings | |
| 6,032,814 | A | | 3/2000 | Foster | |

FOREIGN PATENT DOCUMENTS

| | | |
|---|---|---|
| DE | G 91 10 779.2 | 2/1993 |
| EP | 0 084 697 A1 | 8/1983 |
| EP | 0 295 767 A2 | 12/1988 |
| EP | 0 365 753 A2 | 5/1990 |
| EP | 0 365 770 A1 | 5/1990 |
| EP | 0 424 571 A1 | 5/1991 |
| EP | 0 461 277 A1 | 12/1991 |
| EP | 0 477 588 A2 | 4/1992 |
| EP | 0 482 814 A1 | 4/1992 |
| EP | 0 211 122 A1 | 2/1997 |
| EP | 1 013 345 A2 | 6/2000 |
| FR | 930810 | 7/1946 |
| FR | 1.017.696 | 12/1952 |
| FR | 1.494.3.17 | 9/1967 |
| FR | 2.101.505 | 3/1972 |
| GB | 1 480 382.1 | 7/1977 |
| GB | 2 060 784 A | 5/1981 |
| GB | 2 094 411 A | 9/1982 |
| GB | 2163 632 A | 3/1986 |

OTHER PUBLICATIONS

1382836 Reciprocating Pumps—Binks–Bullows Ltd., Jul. 25, 1972, National Reference Library of Science and Inventors, Div. F1, p. 441.

1498224 Reciprocating Pumps, Graco, Inc., Jun. 5, 1975, National Reference Library of Science and Inventors, Div. F1, p. 800.

1233255 Reciprocating Pumps, Burgess Products Co. Ltd, Nov. 23, 1968,National Reference Library of Science and Inventors, p. 153.

764,166, Reciprocating Pums, J. Wagner, Vertriebsbes, Inc., Feb. 22, 1955.

773,367 Pumps for Spraying Apparatus, T. Krebs, May 12, 1954.

916,901, Reciprocating Pumps, J. Wagner, Vertriebsgesellschaft, Inc., Apr. 9, 1959.

* cited by examiner

LIQUID SPRAYERS

CROSS-REFERENCE TO RELATED APPLICATION

This application is a continuation in part of U.S. patent application Ser. No. 09/638,483, filed Aug. 14, 2000, now U.S. Pat. No. 6,502,766 issued Jan. 7, 2003, which is a continuation in part of the U.S. Ser. No. 09/624,061, filed Jul. 24, 2000 now abandoned.

TECHNICAL FIELD OF THE INVENTION

This invention relates to the field of liquid sprayers, and, more particularly, to the field of liquid sprayers having an electrical motor driving a pump.

BACKGROUND OF THE INVENTION

Sprayers have been generally used to spray liquids in order to atomize as fine droplets a liquid. The atomization of a liquid enables better coverage of a surface by the liquid. Usually, sprayers comprise a container which is used to store the liquid and which is connected to a sprayer head. The sprayer head usually includes a trigger which activates a pump that drives the liquid to the nozzle which, in turn, atomizes the liquid. These sprayers are manually activated and require the user to push the trigger several times as long as she wishes to spray the liquid. In addition to requiring the user to push the trigger several times, those manually activated sprayers can only maintain a uniform pattern of spray for a relatively short period of time. One of the improvements made to the sprayers was to incorporate an electrical motor connected to a switch and a portable voltage source to them. This type of electrical sprayer only requires the user to push the trigger once and maintain the trigger pushed as long as the user wants to spray liquid. It is common to have a sprayer with a nozzle having at least two positions and which operates as a check valve. A first position usually prevents a liquid to flow through the nozzle and a second position allows the liquid to flow through the nozzle, which in turn, allows the user to spray the liquid. Typically, the user simply rotates the nozzle to move the nozzle from the first to the second position and vice versa. Once the user has finished spaying the liquid, she can simply rotate the nozzle back to its first position. Other types of nozzles include a hinged gate member that the user can flip to allow or prevent a liquid to be sprayed. These nozzles prevent a liquid from flowing out of the sprayer in case the sprayer is accidentally tilted from its upright position. However, it has been found that very often when the user has finished spraying a liquid, she does not use these safety mechanisms. It can easily be contemplated that in the case of an electrical sprayer, the use of electrical components such as a switch, a motor and a voltage source makes those electrical sprayers sensitive to liquid which might be responsible of malfunction of the device in the event the liquid comes in contact with those components. As a result, another problem faced with those electrical sprayers is to provide a device which can limit the risk that the liquid to be sprayed might enter in contact with the electrical components without requiring any extra step to be accomplished by the user.

For the foregoing reasons, there is a need for an electrical sprayer which limits the risk of malfunction due to contacts between a liquid to be sprayed and electrical components and also limits the risk of spills which can cause damages to the skin or to property.

SUMMARY OF THE INVENTION

A liquid sprayer is provided. In one non-limited embodiment, the liquid sprayer includes a bottle having an opening and a sprayer housing attached to the bottle. This sprayer housing includes an electrical motor, a voltage source for powering the electrical motor, a pump driven by the motor, a switch for completing an electrical circuit, a nozzle mechanism attached to the sprayer housing for spraying a liquid and a venting mechanism comprising a vent housing and a translating piston. The sprayer housing also includes a trigger movably connected to the sprayer housing for closing the switch, translating a piston and creating a leak-tight seal by squeezing a pump discharge tube. A pump supply tube extends from the opening of said bottle to an inlet of the pump and the pump discharge tube extends from the outlet of the pump to an opening of the nozzle mechanism. The pump discharge tube is flexible and deformable so that it can be optionally, but preferably, bent to form a loop around a pole member fixedly positioned between the outlet of the pump and the discharge outlet of the nozzle mechanism.

BRIEF DESCRIPTION OF THE DRAWINGS

While the specification concludes with claims particularly pointing out and distinctly claiming the invention, it is believed that the present invention will be better understood from the following description taken in conjunction with the accompanying drawings in which:

FIG. 16.

DETAILED DESCRIPTION OF THE PREFERRED EMBODIMENTS

Figure 1:
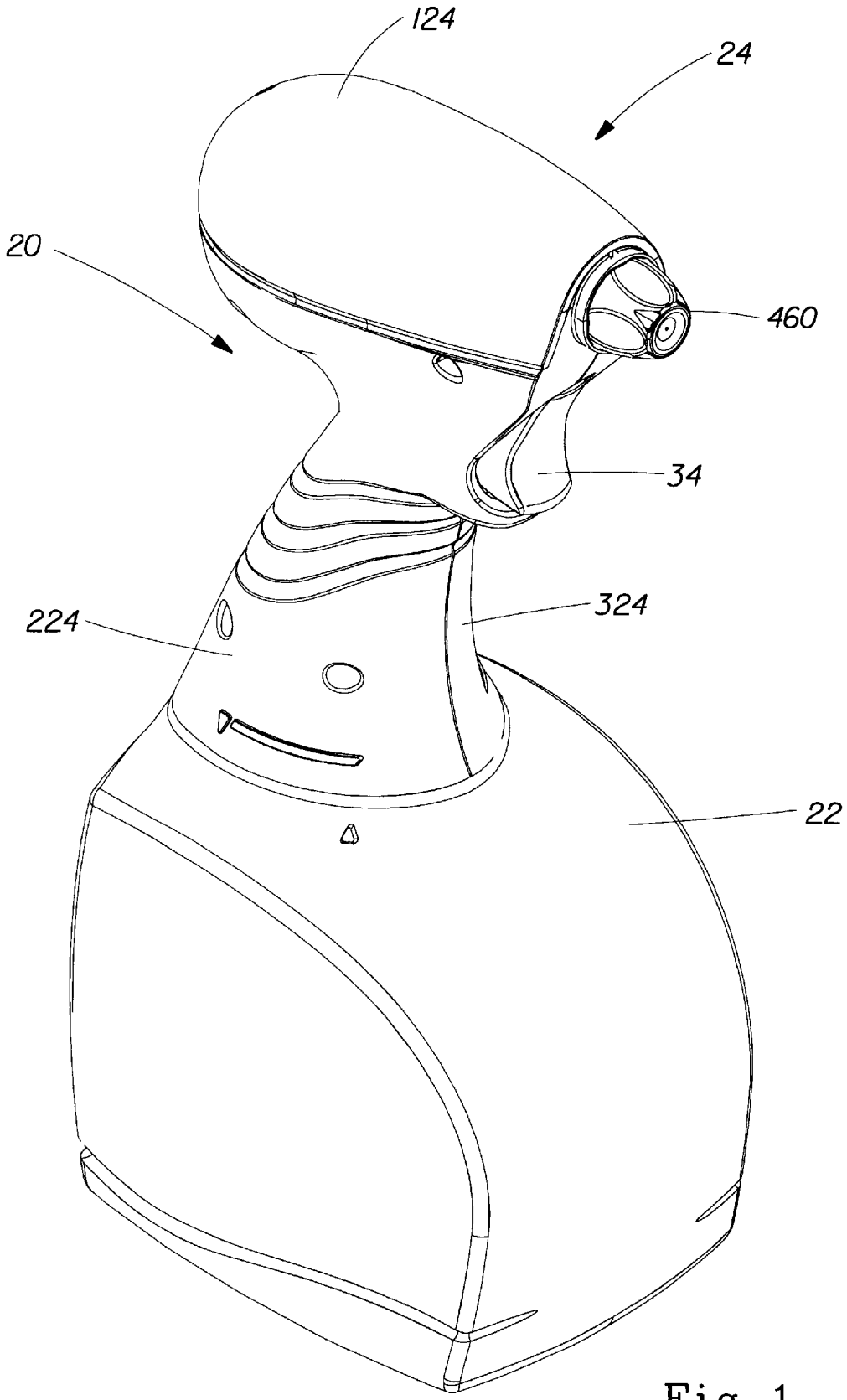
FIG. 1 is a perspective view of the liquid sprayer showing the sprayer head connected to the bottle.

Reference will now be made in detail to the present preferred embodiments of the invention, examples of which are illustrated in the accompanying drawings wherein like numerals indicate the same elements throughout the views and wherein reference numerals having the same last two digits (e.g., 20 and 120) connote similar elements. Referring to FIG. 1, a preferred liquid sprayer 20 comprising a bottle or reservoir 22 and a sprayer head 24 is illustrated which is suitable for spraying a variety of liquid compositions. While the liquid sprayer 20 is particularly suited for use with household-compositions, it is contemplated that other liquid compositions can be used with the liquid sprayer 20 such as for example chemically aggressive liquid compositions. The bottle 22 preferably has a capacity of about 1 liter, although other bottle sizes can be used.

Figures 2, 2A:
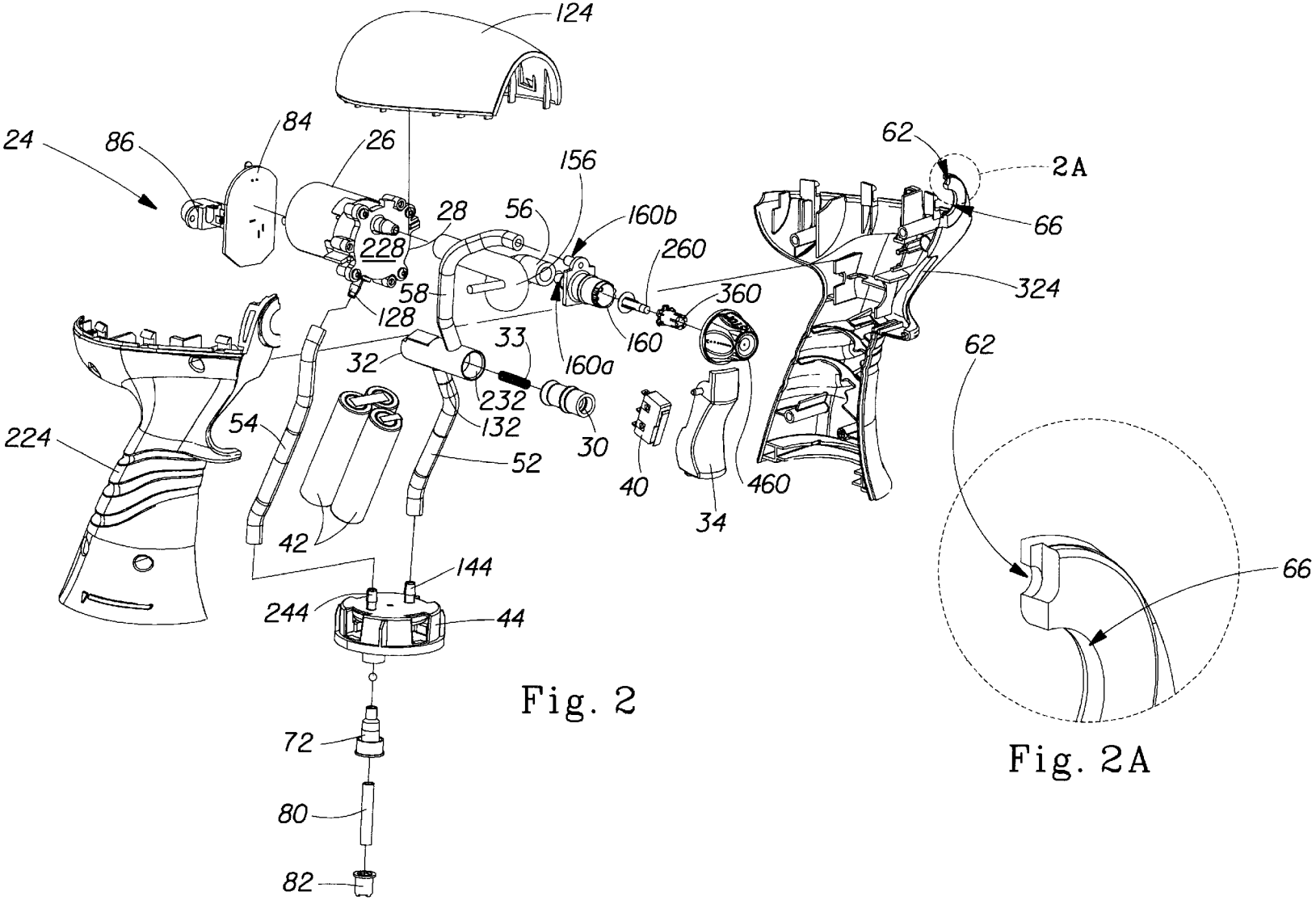
FIG. 2 is an exploded view of a preferred liquid sprayer made in accordance with one embodiment of the present invention but omitting the bottle for clarity and where the pinched tube mechanism is used for the discharge tube.
FIG. 2*a* is a fragmentary enlargement of FIG. 2 showing the semi-circular openings on the lower housing.
Figure 8:
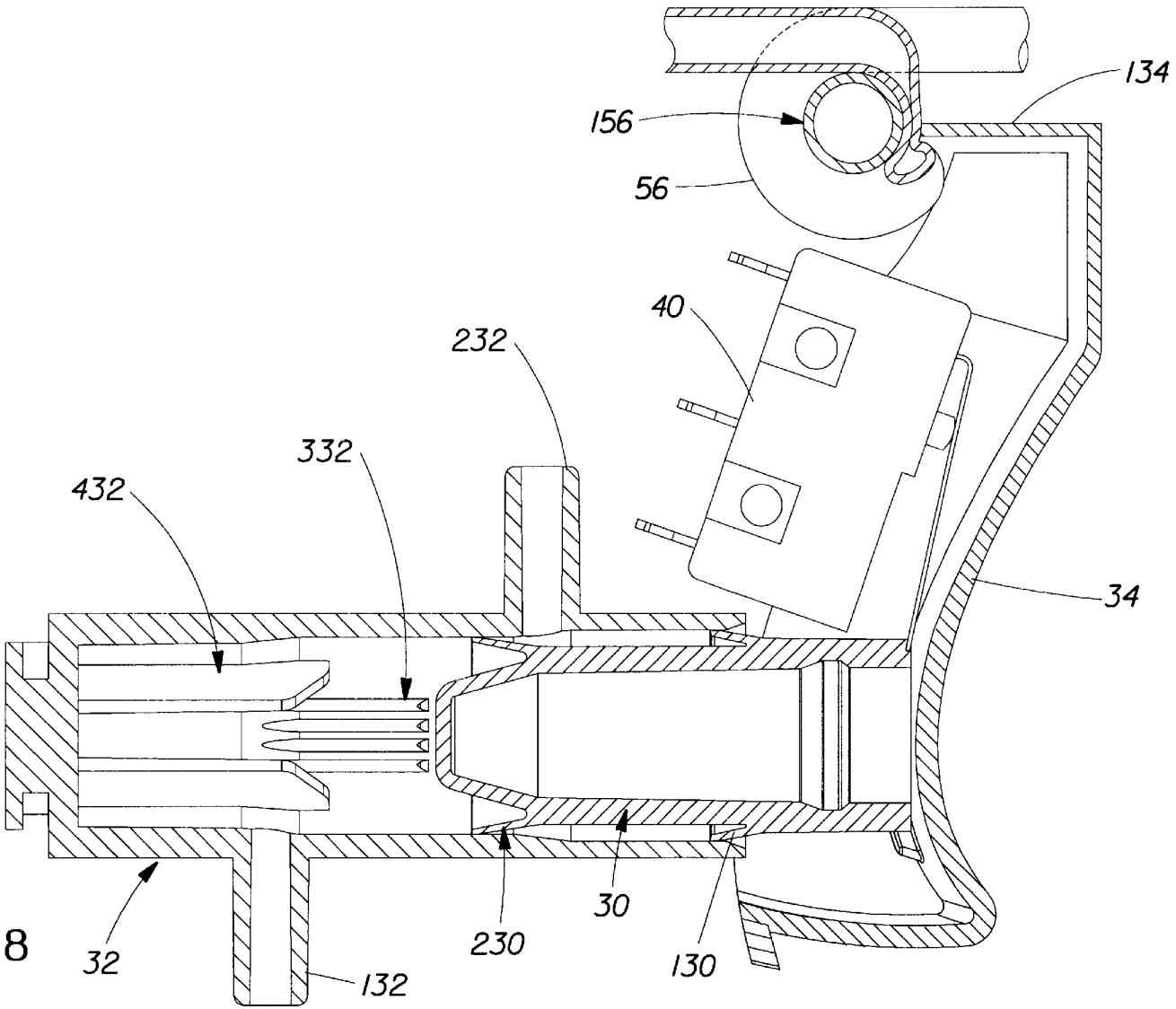
FIG. 8 is a cross-sectional side view of the venting mechanism in the first position with the trigger, the switch and the "pinched tube" mechanism used for the discharged tube, where the pump discharge tube is squeezed; the compression spring is omitted for clarity.
Figure 9:
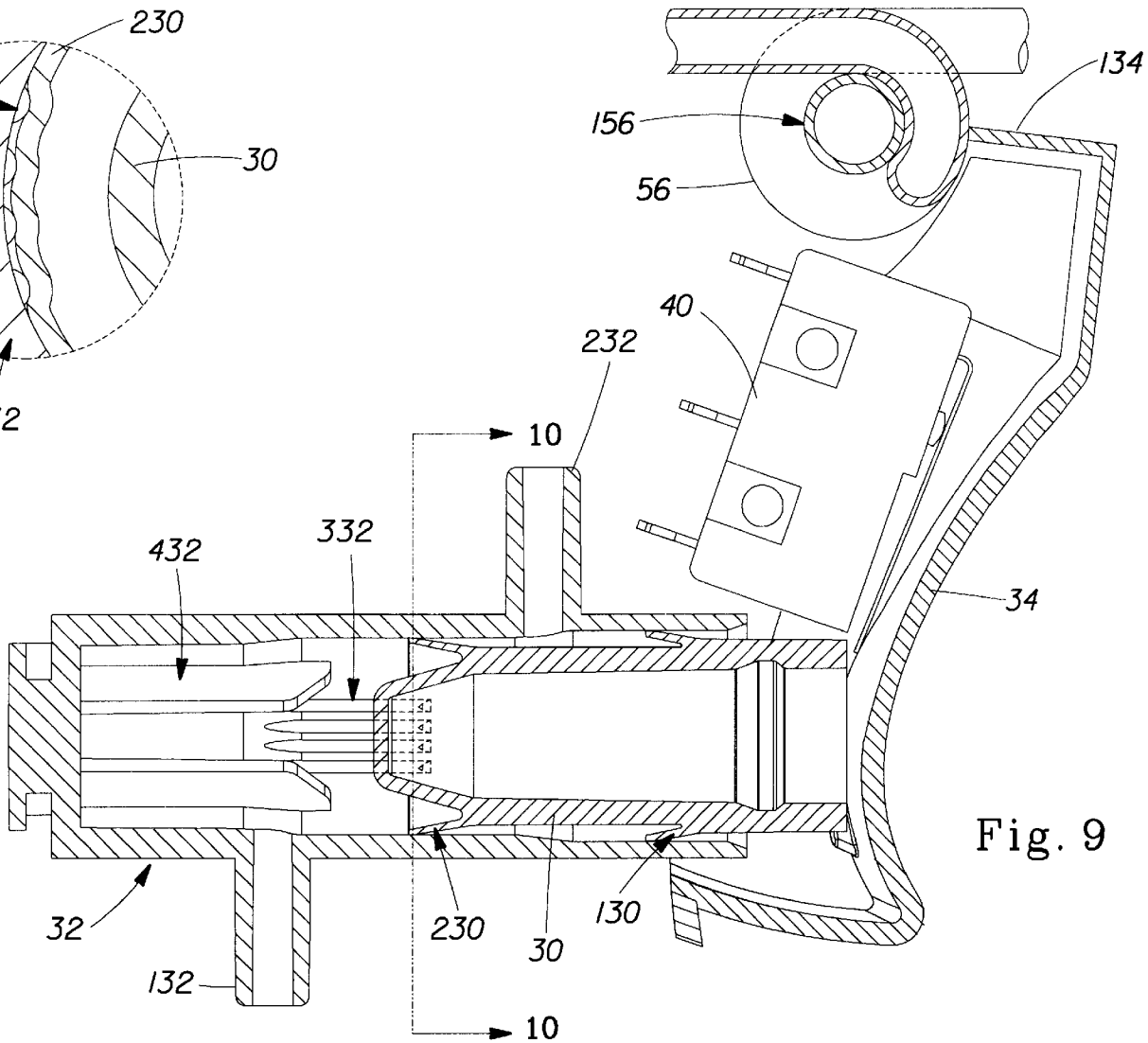
FIG. 9 is a cross-sectional side view of the venting mechanism in the second position with the trigger, the switch is closed and the "pinched tube" mechanism where the pump discharged tube is not being squeezed and where the compression spring has been removed for clarity.
Figure 11:
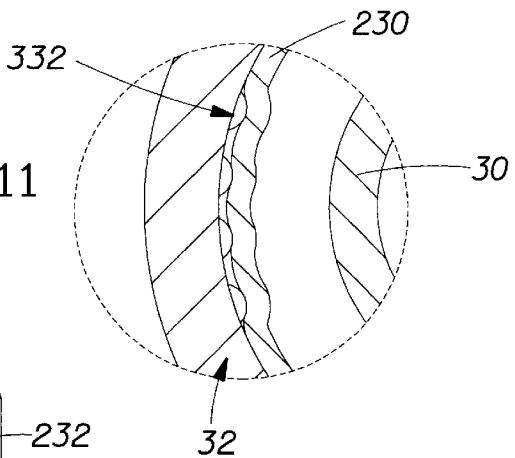
FIG. 11 is a fragmentary enlargement of FIG. 10 showing the deformation of the chevron member.
Figure 10:
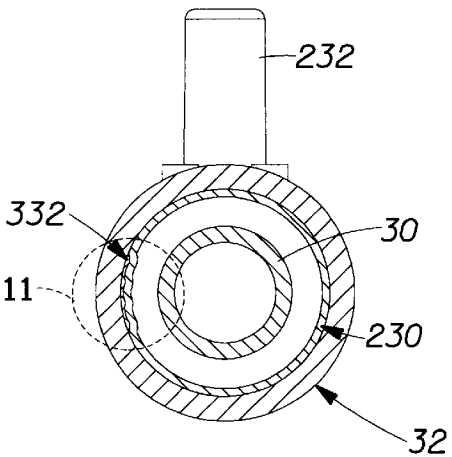
FIG. 10 is a cross-sectional view along line 10—10 of FIG. 9 of the vent housing with the translating piston.
Figures 12, 12A:
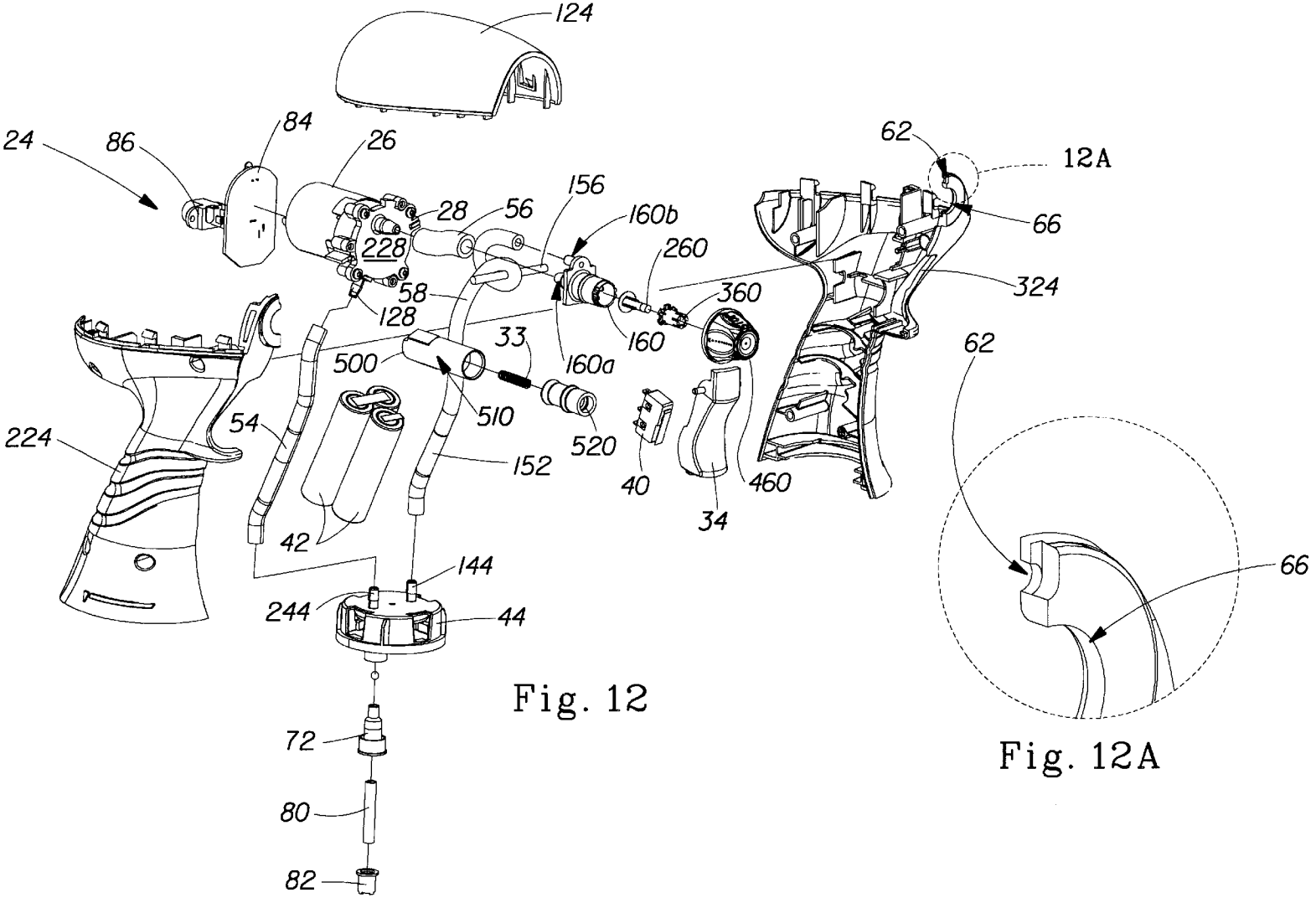
FIG. 12 is an exploded view of a liquid sprayer made in accordance with another embodiment of the present invention but omitting the bottle for clarity and where the pinched tube mechanism is used for the vent tube.
FIG. 12*a* is a fragmentary enlargement of FIG. 12 showing the semi-circular openings on the lower housing.
Figure 13:
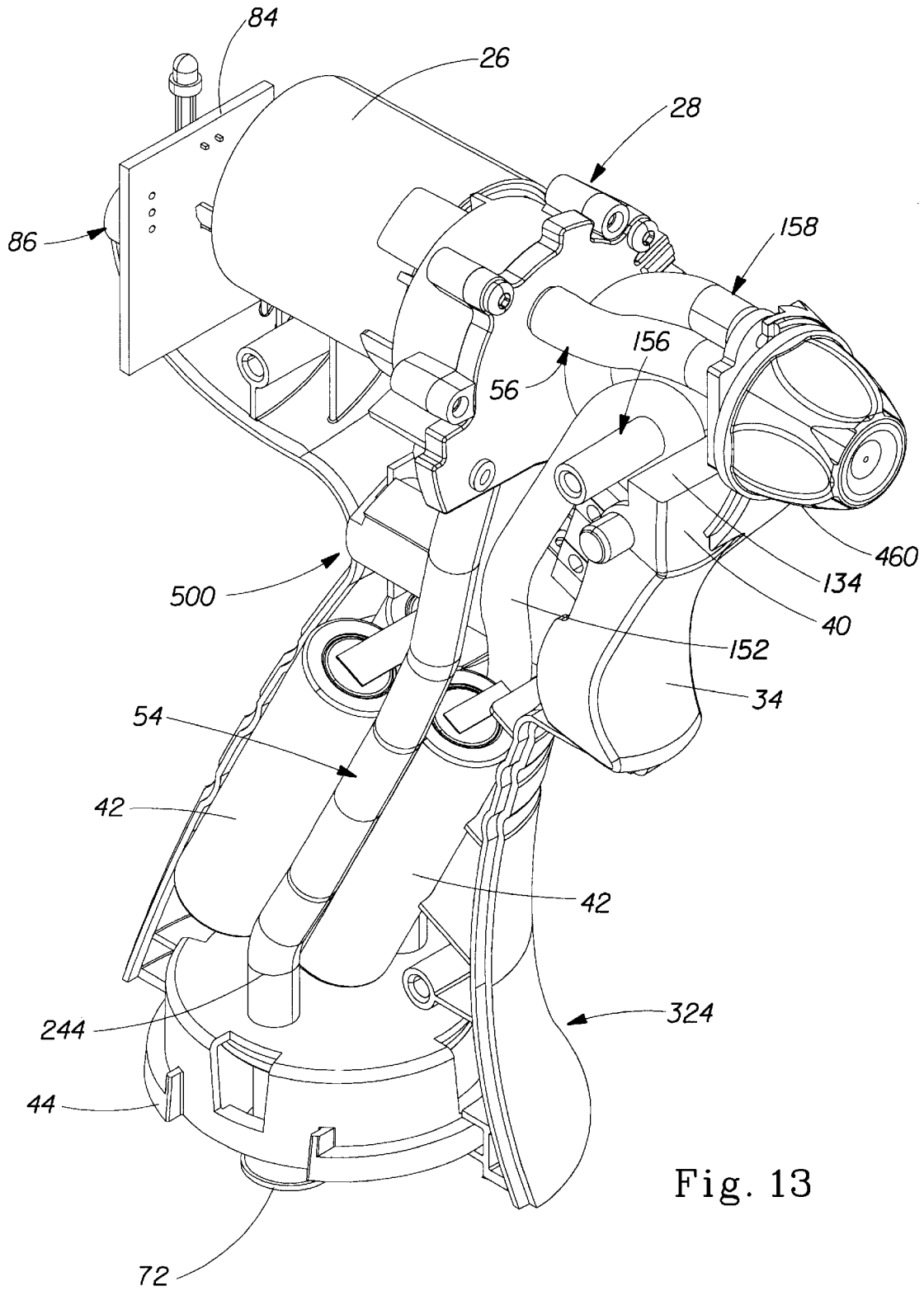
FIG. 13 is a perspective view of the sprayer head assembled without the upper shell and one of the lower housing made in accordance with one embodiment of the present invention according to FIG. 12.

Referring to FIG. 2, the sprayer head 24 comprises the upper shell 124 and two lower housings 224 and 324 connectable with snap or screw connections. Instead of a sprayer head comprising three elements 124, 224 and 324, other housing structures are possible without departing from the scope of protection. The sprayer head 24 houses the spray mechanics, including an electrical motor 26 which is directly coupled to a gear pump 28 and a venting mechanism including a vent piston 30 slidably disposed within a vent housing 32 and a spring 33 biasing the vent piston in the direction of a trigger 34. As shown in FIGS. 8 and 9, a first position of the vent piston 30 in the vent housing 32 prevents venting from occuring and a second position of the vent piston 30 in the vent housing 32 enables venting in the bottle. The venting mechanism will later be described in greater details. The trigger 34 is movably attached to left and right housings 224 and 324 when the liquid sprayer is assembled. The trigger 34 translates the vent piston 30 within the vent housing 32 and closes a switch 40. Preferably, the vent piston and switch are arranged so that the vent piston 30 begins to translate before the trigger 34 closes the switch 40. Most preferably, the vent piston 30 and switch 40 are arranged so that the vent piston is in the second position, and therefore enables venting, before the trigger 34 closes the switch 40. When closed by the trigger, the switch 40 completes an electrical circuit between a portable voltage source, illustrated as a plurality of batteries 42, and the electrical motor 26 and thereby activates the gear pump 28. While the pump 28 is preferably provided in the form of a gear pump, other pumps and structures for pressurizing a liquid and delivering the liquid to the nozzle mechanism 60 can be used. For example, vane, piston, lobe, or diaphragm pumps would be acceptable for use. The gear pump 28 is maintained in position by being engaged in two slots located in each of the housings 224 and 324.

Figure 3:
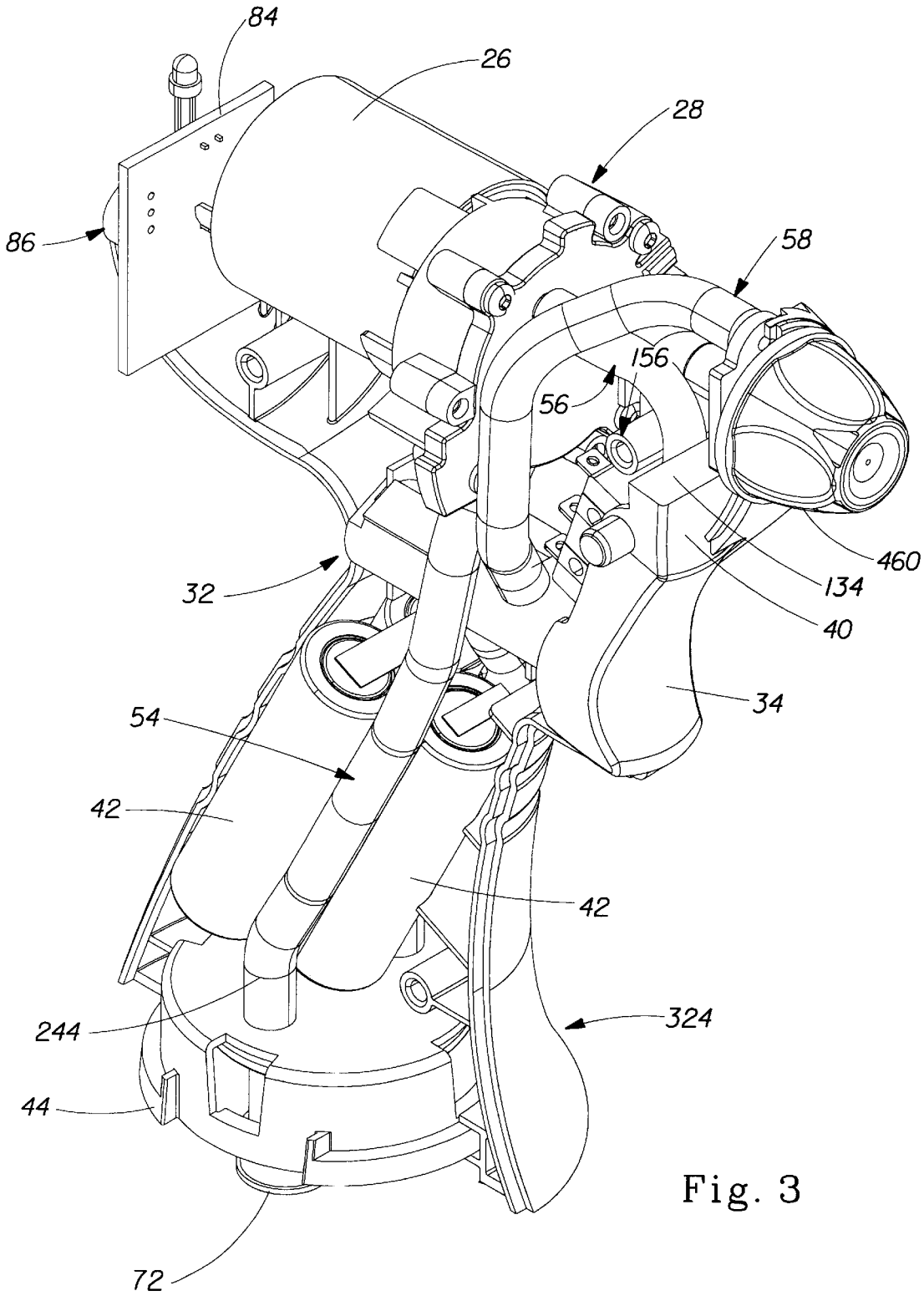
FIG. 3 is a perspective view of the sprayer head assembled without the upper shell and one of the lower housing made in accordance with one embodiment of the present invention.
Figure 5:
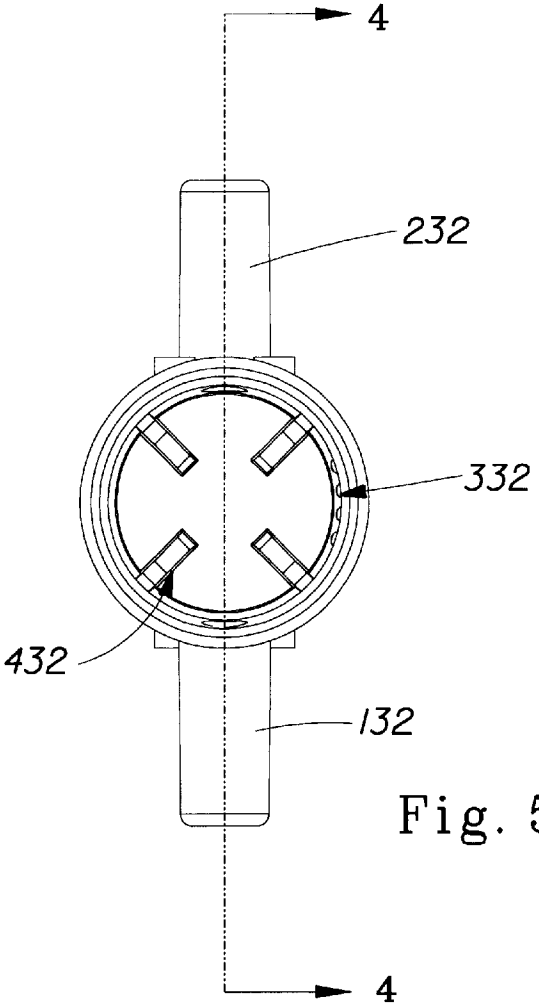
FIG. 5 is a side view of the vent housing of FIG. 2.

In one embodiment of the invention shown in FIG. 3, the first vent tube 52 is connected to the first opening 132 of the vent housing 32 and extends towards the opening of the bottle 22 while a pump supply tube 54 is connected to the inlet 128 of the gear pump 28 and also extends towards the opening of the bottle 22. In one embodiment of the invention, the electrical sprayer comprises a "pinched tube" mechanism. One skilled in the art will understand that this "pinched tube" mechanism may be used with manually operated sprayers, pneumatic sprayers or electrical sprayers. In the embodiment comprising the "pinched tube" mechanism, a pump discharge tube 56 interconnects the pump outlet 228 with a nozzle adapter 160 through a first passage 160*a*. In one embodiment of the invention, the different tubes used for the sprayer, such as the pump discharge tube 56 and the vent tubes, are silicone tubing such as one manufactured by Norton Performance Plastics Corporation in Beaverton, Mich. 48612, under the name TYGON® Formulation 3350, but one skilled in the art will understand that other material may be used to make those tubes and still provide the same benefits. The pump discharge tube 56 is flexible enough to be optionally but preferably bent in order to be angled and to be applied against a pole member 156. In a preferred embodiment of the invention, the pole member 156 serves as a mandrel and the pump discharge tube 56 is bent in order to form at least one loop around the pole member 156. The pump discharge tube 56 is also deformable such that when it is radially subjected to pressure or "pinched", at least a portion of the pump discharge tube 56 collapses in order to create a leak tight seal preventing a liquid from flowing, but it returns to its original shape when pressure is released and thus allows a liquid to flow through the tube. The pole member 156 extends from one of the housings 224 or 324 towards the opposite housing. The pole member 156 may be for example a guide member used to guide a screw which secures the housing 224 and 234 together. In one embodiment of the invention, at least one portion of the trigger 34, preferably the upper portion 134 of the trigger 34, compresses a portion of the discharge tube 56 against the pole member 156 such that liquid is prevented from flowing through the nozzle mechanism 60. The biasing action of the spring 33 on the translating piston 30 and trigger 34 generates the compression of the upper portion 134 of the trigger 34 against a portion of the discharge tube 56 and is schematically represented in FIG. 8. When the user actuates the trigger 34, the spring 33 is compressed and the pressure on the discharge tube is released. Consequently, liquid can flow in the discharge tube to the nozzle mechanism 60, which is schematically represented in FIG. 9. When the user releases pressure on the trigger 34, the spring 33 biases the translating piston 30 and the trigger 34. As a result, the upper portion 134 of the trigger 34 compresses a portion of the discharge tube 56 and sealingly prevents liquid from flowing through the nozzle 60. One of the benefits of the "pinched tube" is that it allows using a simpler and less expensive nozzle. It is common to have a sprayer with a nozzle having at least two positions and which operates as a check valve. A first position usually prevents a liquid to flow through the nozzle and a second position allows the liquid to flow through the nozzle, which in turn, allows the user to spray the liquid. Typically, the user simply rotates the nozzle to move the nozzle from the first to the second position and vice versa. Once the user has finished spraying the liquid, he can simply rotate the nozzle back to its first position. Other nozzles include a hinged gate that the user can flip in order to allow or prevent a liquid to flow. These safety mechanisms prevent a liquid from flowing out of the sprayer in case the sprayer is accidentally tilted from its upright position but they also serve as a child safety mechanism. However, it has been found that very often when the user has finished spraying a liquid, she does not actuate the safety mechanism of the nozzle which can lead to the liquid leaking through the nozzle in the event the sprayer is tilted from its upright position. The "pinched tube" operates as a check valve and does not require any further manipulation by the user. As a result, a nozzle comprising a safety mechanism becomes optional.

One of the benefits of preventing liquid from flowing through the nozzle when the sprayer is not being used is to significantly reduce the risk of leakage of the sprayer when the sprayer is accidentally tilted. The liquid contained in the bottle may comprise chemically aggressive liquid composition which should not be able to accidentally get in contact with surfaces which can be damaged by the composition or the consumer skin. Another benefit is to also prevent liquid from flowing back into the bottle. When the sprayer has been primed, i.e. the discharge circuit comprised of the pump supply tube 54, the gear pump 28 and the discharge tube 56 is filled with liquid, the compression of the discharge tube 56 generates a negative pressure which maintains liquid in the discharge circuit. This is beneficial for the efficiency of the sprayer and a better use of the electrical energy stored in the batteries. When the consumer uses the sprayer for the first time, the sprayer needs to be primed. By preventing liquid from flowing back into the bottle, the compressed tube maintains the sprayer primed. When the user is subsequently using the sprayer, it is already primed and, as a result, electrical energy is saved on the priming operation. Another benefit is to prevent liquid from drying in the discharge tube and in the gear pump. By compressing the discharge tube, the upper portion of the trigger prevents ambient air to be in contact with the liquid and thus it also prevents the liquid from evaporating and the discharge circuit from drying. By preventing the liquid from evaporating, the formation of crystals or sticky residue, which can clog and damage the gear pump or the pump of a manually operated sprayer, is also prevented and therefore the "service life" of the sprayer is extended. In addition, it has been found that the liquid acts as a lubricant with the components of the gear pump, particularly with the gears which can be made, for example of plastic. Those gears wear and tear over time, more particularly when there are not lubricated.

Figure 21:
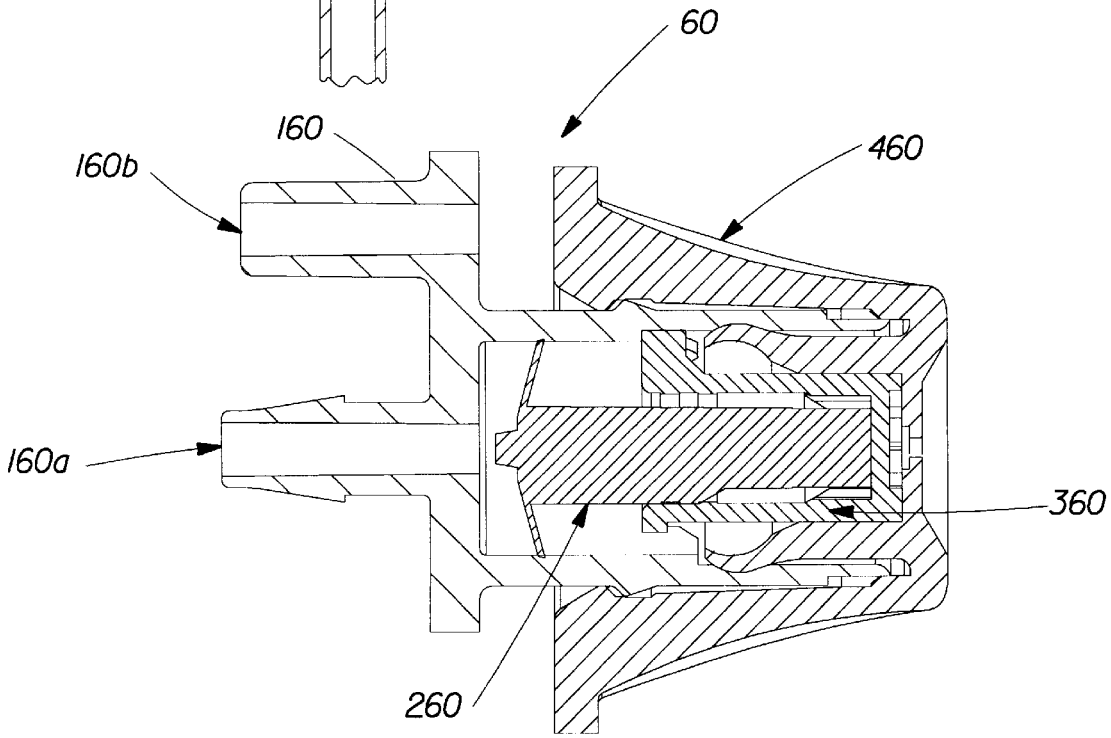
FIG. 21 is a cross-sectional side view of the nozzle mechanism with the nozzle adapter, the discharge valve, the spin mechanics and the nozzle of the liquid sprayer of FIG. 2, FIG. 12.

In another embodiment of the invention, a second vent tube 58 interconnects the second opening 232 of the vent housing 32 with an opening of the sprayer housing wherein the vent aperture is exposed to the ambient environment. In yet another embodiment of the invention shown in FIG. 2, the nozzle mechanism 60 comprises a nozzle adapter 160, optionally a discharge valve 260, spin mechanics 36 and a nozzle head 460. The nozzle adapter 160 comprises a liquid intlet 160*a* and a vent aperture 160*b*. In this embodiment, the second vent tube 58 interconnects the second opening 232 of the vent housing 32 with the vent aperture 160*b* disposed on the nozzle adapter 160, wherein the vent aperture is exposed to the ambient environment through semicircular cut-outs 62 in each of the housings 224 and 324, shown in FIG. 2A. The vent aperture 160*b* is located upwardly and axially away from the switch 40 so that in the event the sprayer is in a substantially downward position and a liquid has been able to enter in the vent tubes, this liquid will drop away from the switch 40 and thus substantially limit the risk of contact between the liquid and the switch. As a result, the location of the vent aperture 160*b* disposed on the nozzle adapter 160 limits the risk of malfunction of the sprayer. The nozzle adapter 160 has a hollow post which passes through larger semicircular cut-outs 66 in each of the housings 224 and 324. Disposed within the hollow post are the spin mechanics 360 and optionally a discharge valve 260. A nozzle head 460 is mounted on the nozzle adapter 160 as shown in FIG. 21.

Figure 20:
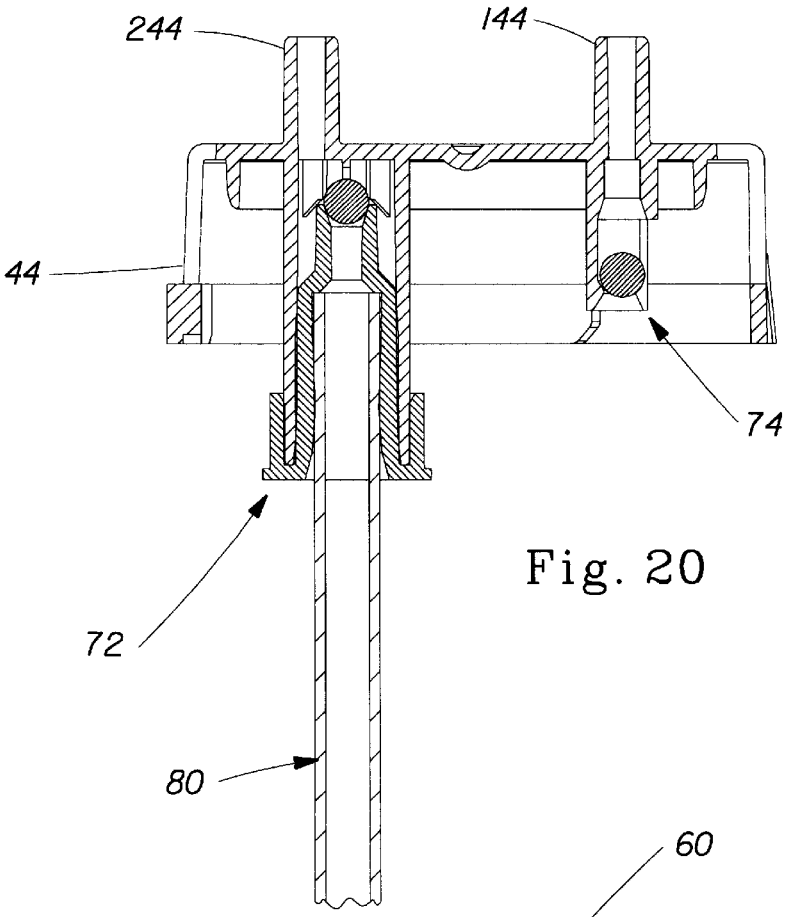
FIG. 20 is a cross-sectional view of the fitment, the check valves and the dip tube.

In one embodiment of the invention, a fitment 44, as shown in FIG. 3 and FIG. 20, is disposed adjacent the bottom of the lower housings 224, 324 (not shown for clarity) and comprises a bayonet-type fitment for engaging a complementary fitment on the finish of the bottle 22. The fitment 44 is maintained in position by being engaged in two slots located in each of the housings 224 and 324 and by the mechanical stress which is applied on the fitment and the finish of the container. The fitment 44 includes first and second through passages 144 and 244. The first vent tube 52 interconnects the first through passage 144 with a first opening 132 of the vent housing 32 while a pump supply tube 54 interconnects the second through passage 244 with the inlet 128 of the gear pump 28. A first check valve 74 is connected to the first through passage 144 and prevents a liquid from significantly exiting the bottle through the vent 160*b* when the bottle is in a substantially downward position. In one embodiment of the invention, a second check valve 72 is optionally connected to the second through passage 244 and prevents a liquid from significantly reentering into the bottle 22 when the pump 28 is not functioning. A dip tube 80 extends from the bottle 22 and the second check valve 72 to supply the sprayer with liquid. A dip tube filter 82, shown in FIG. 2, can be added at the lower end of the dip tube 80 to prevent particles which may obstruct the nozzle and/or pump from reaching it. In order to effectively spray a liquid, the gear pump 28 will initially need to be primed. By preventing a liquid to significantly reenter into the bottle when the user releases the trigger 34 the second check valve 72 cooperate with the "pinched tube" to trap liquid in the discharge circuit and further eliminate the need to re-prime the gear pump after each use of the sprayer. As a result, the efficiency of the liquid sprayer is further improved by saving energy in the voltage source. The cracking pressure of the check valve 72 should be sufficient so that a liquid entering the pump supply tube 54 has enough energy to be driven through the gear pump 28, through the nozzle mechanism 60 and break the fluid up into fine droplets. The first and the second check valve, 70 and 72, may be ball valve or other type of check valves commonly known in the art, such as a membrane valve. In another embodiment of the invention, the fitment 44 includes at its lower end a leak tight seal to prevent leakage of the liquid from the bottle.

The electrical motor 26, represented FIG. 2, is preferably a direct current electrical motor. The electrical motor 26 has two electrical connections which are preferably connected with electrical wires to the portable voltage source, illustrated as a plurality of batteries 42 in series, with the switch 40. When the trigger 34 is activated, the translating piston 30 comes to the second position so that venting occurs substantially before the switch 40 is closed. When the switch 40 is closed, an electrical current flows through the electrical motor 26 which rotates the gears of the pump 28 to generate a pressure sufficient to open the check valve 72 so that a liquid can flow through the nozzle 60. The occurrence of the venting substantially before the switch 40 is closed helps to improve the efficiency of the liquid sprayer by equalizing the pressure inside the bottle with the pressure of the ambient environment before the pump is activated. An exemplary motor is a 3 volt to 6 volt series 200 or 300 motor manufactured by Mabuchi Industry Company, Ltd. Of China. Preferably, the motor is a 4.5 volt model RS360SH manufactured by Mabuchi Industry Company, Ltd. An exemplary spray nozzle is manufactured by Calmar, INC. and more fully described in U.S. Pat. No. 4,706,888 to Dobbs et al, issued Nov. 17, 1987, the substance of which is fully incorporated herein by reference. The sprayer housings 124, 224, 324, nozzle mechanism 60, gear pump 28, fitment 44, vent housing 32 and venting piston 30 can be injection molded using thermoplastic materials as is known in the art. Preferably, the spin mechanics, the fitment, the vent housing and the nozzle adapter are formed from polypropylene and the pump housing, the pump cap and the pump gears are formed from acetal polymer. Preferably, the sprayer housings 124, 224, 324 and the trigger are formed from a blend of acrylonytrile-butadiene-styrene and polycarbonate. Preferably, the vent piston, and the nozzle are formed from polyethylene. The voltage source 42 can be either rechargeable or non-rechargeable batteries. In the case of non-rechargeable batteries, the voltage source 42 is preferably three AA, 1.5 volt Panasonic or Sanyo Alkaline batteries which are connected in series.

Figure 4:
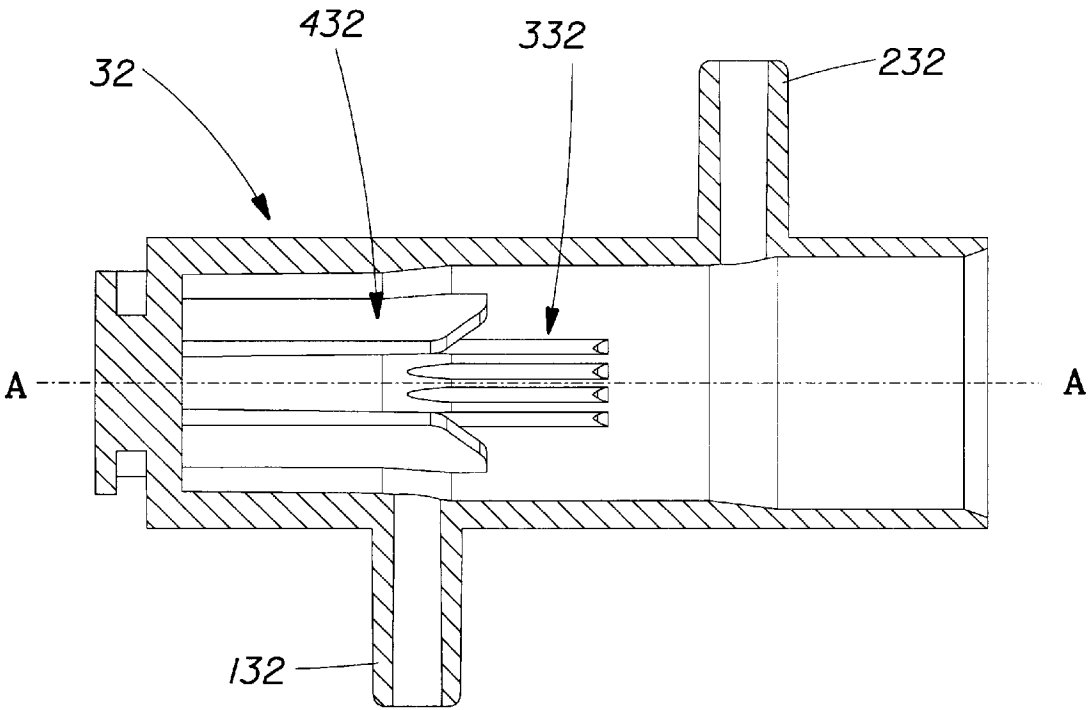
FIG. 4 is a cross-sectional side view along line 4—4 of FIG. 5 of the vent housing of the liquid sprayer of FIG. 2.
Figure 7:
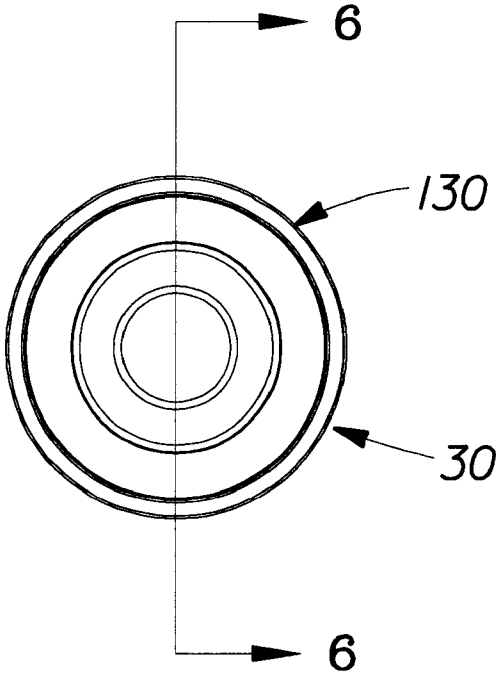
FIG. 7 is a side view of the vent piston of the liquid sprayer of FIG. 2.
Figure 6:
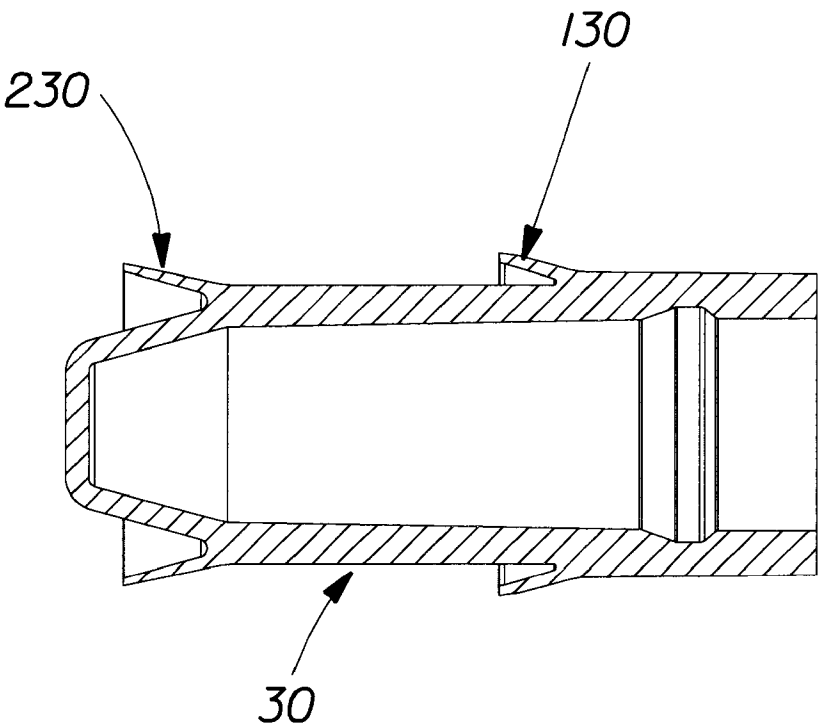
FIG. 6 is a cross-sectional side view along line 6—6 of FIG. 7 of the vent piston of the liquid sprayer of FIG. 2.

In accordance with one aspect of the present invention, the venting mechanism will now be described in greater detail with reference to FIG. 4 through FIG. 11. The venting mechanism includes a vent housing 32 and a translating piston 30. The vent housing is preferably a hollow cylinder closed at one end and having two openings 132 and 232 located on the cylinder's wall. Preferably, the two openings are spaced apart along the axis A—A of the vent housing as shown in FIG. 4. The other end of the vent housing is left open to enable the translating piston 30 to enter the vent housing. As shown in FIG. 6, the translating piston 30 is substantially a cylinder whose diameter is smaller than the inner diameter of the vent housing so that it can slide within the vent housing 32. When used in accordance with this invention, one extremity of the translating piston is closed and the other extremity is in contact with the trigger 34 so that motion of the trigger will translate the piston within the vent housing. The translating piston also comprises a first and second deformable component having a portion that has a surface in contact with the inner surface of the vent housing and is capable of being deformed to leave a gap. The first deformable component is located on the translating piston so that when the piston is in a first position as shown in FIG. 8, and in a second position as shown in FIG. 9, air cannot flow between the second opening 232 and the open end of the vent housing 32. The second deformable component is located on the translating piston 30 so that when the piston is in a first position as shown in FIG. 8, air cannot flow between the first and second opening, 132 and 232, and when the piston is in a second position as shown in FIG. 9, air can flow between the first opening 132 and the second opening 232 of the vent housing 32. In one embodiment of the invention, those deformable components are a first and a second chevron shaped member (herein after "chevron member" for simplicity) 130 and 230, located on the outer surface of the translating piston. As defined with regard to this invention, a chevron member is preferably a flexible ring with one edge connected to the outer surface of the translating piston. The chevron member has a V shape when viewed from the side. Those chevron members can also be formed onto the surface of the piston when the piston is molded. The largest diameter of those chevron members is longer than the inner diameter of the vent housing so that the other edge of the chevron members is close, but slidable in contact with the inner surface of the vent housing when the translating piston slides in it. As a result, air cannot flow through those chevron members and, thus, a sealing effect is provided. In one embodiment of the invention, the vent housing includes means for deforming the second chevron member 230, and located on the inner surface of the vent housing between the first and the second opening. When the trigger 34 is activated, the translating piston leaves its first position and moves towards the deforming means. When the second chevron member 230 encounters the deforming means, it is deformed and leaves a gap and thus the piston reaches the second position. Because of the gap created by the deformation of the chevron member, air can flow between the first and the second opening of the vent housing to enable venting. This deforming means is so that it will keep the second chevron member deformed at least until the trigger 34 closes the switch 40. Such deforming means can be for instance at least one element projecting from the inner surface of the vent housing. Such element can be in the form of a fin or a rib 332 located in the inner surface of the vent housing between the first and the second opening of the vent housing but other elements may be used to provide the same effect. The element can be either fixed or directly molded on the inner surface of the vent housing. Preferably, the inner surface of the vent housing has four of those elements as shown in FIG. 4. In another embodiment of the invention, the venting mechanism also includes a compression spring located in the vent housing and biasing the translating piston so that when the user releases the trigger, the translating piston comes back to its first position. In one embodiment of the invention, the compression spring is kept centered in the vent housing by fins 432 extending from the closed end of the vent housing towards its opened end.

In another embodiment of the invention shown FIG. 2, the portable voltage source 42 is composed of rechargeable batteries connected by electric wires to a printed circuit board 84 comprising a battery charger jack 86 extending through the sprayer housing. Once the batteries are discharged, the user can connect the charger jack to a charger and thus recharge the batteries. In this embodiment of the invention, the portable voltage source 42 is preferably a pack of three reachargeable AA, 1.2 volt Moltech Nickel-Cadmium batteries which are connected in series such as the pack of batteries that is sold under the reference ECF-800 AA and manufactured by Moltech Power systems located in Gainesville, Fla.

Referring to FIG. 12 through FIG. 15 and in accordance with one aspect of the present invention, another embodiment of the invention is represented.

In this embodiment of the invention, the "pinched tube" mechanism is used for the vent tube. In one embodiment of the invention represented in FIG. 12 and FIG. 13, the pump discharge tube 56 interconnects the pump outlet 228 with a nozzle adapter 160 through a first passage 160*a* and a vent tube 152 is connected to an opening of the housing of the sprayer head and extends towards the opening of the bottle. Preferably, this vent tube 152 is secured to the vent aperture 160*b* disposed on the nozzle adapter 160, wherein the vent aperture 160*b* is exposed to the ambient environment through semicircular cut-outs 62 in each of the housings 224 and 324, shown in FIG. 12A. In a preferred embodiment of the invention, the other end of the vent tube 152 is secured to the first through passage 144 of the fitment 44. The vent tube 152 is flexible enough to be optionally but preferably bent in order to be angled and to be applied against the pole member 156. In a preferred embodiment of the invention, the pole member 156 serves as a mandrel and the vent tube 152 is bent in order to form at least one loop around the pole member 156. The vent tube 152 is also deformable such that when it is radially subjected to pressure or "pinched", at least a portion of the vent tube 152 collapses in order to create a leak tight seal preventing a liquid from flowing towards the vent aperture 160*b*, but it returns to its original shape when pressure is released and thus allows air to flow through the tube which in turn enable venting of the bottle.

Figure 14:
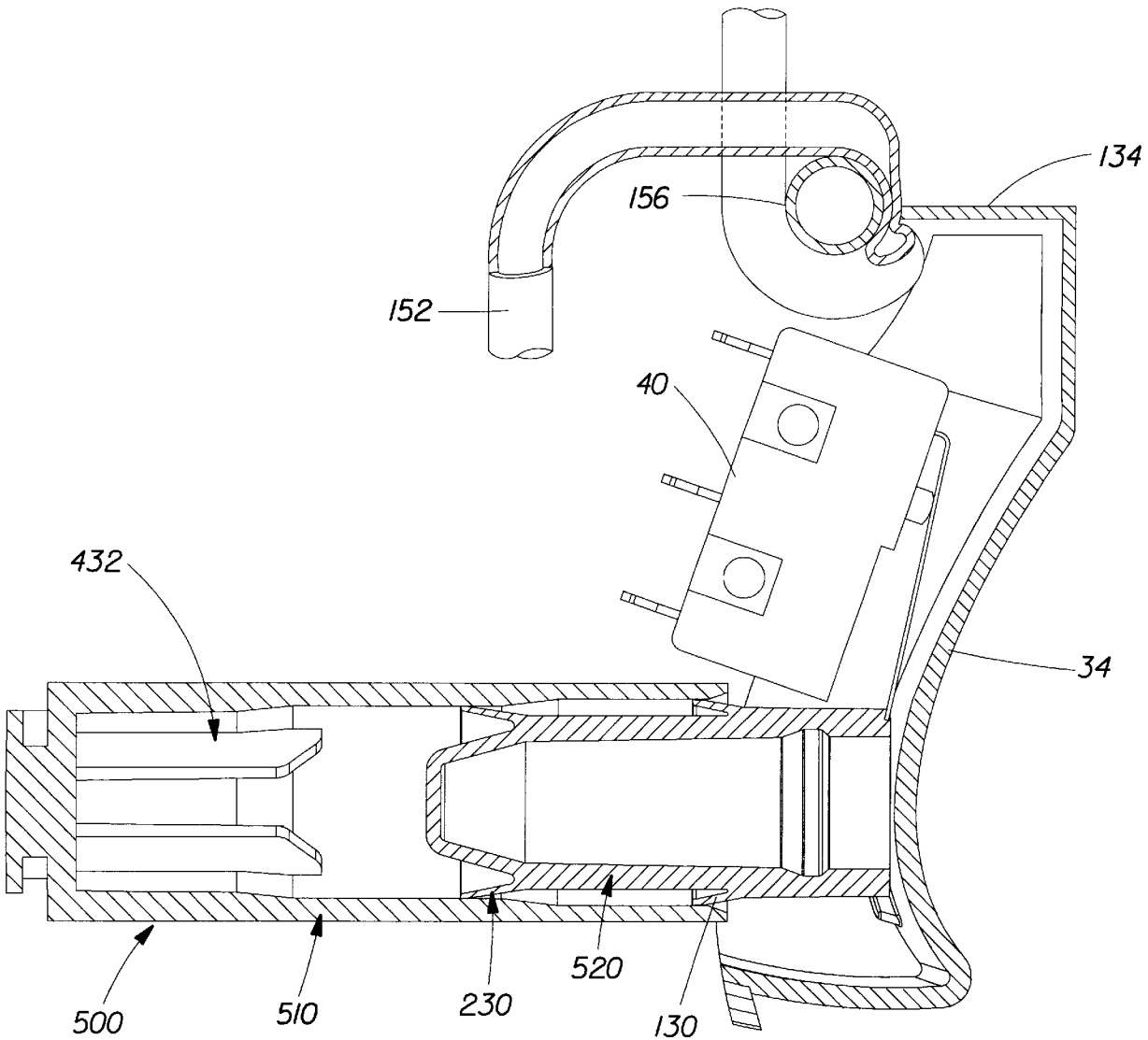
FIG. 14 is a cross-sectional side view of the venting mechanism in the first position with the trigger, the switch and the "pinched tube" mechanism used for the vent tube, where the vent tube is squeezed by the trigger; the compression spring is omitted for clarity.
Figure 15:
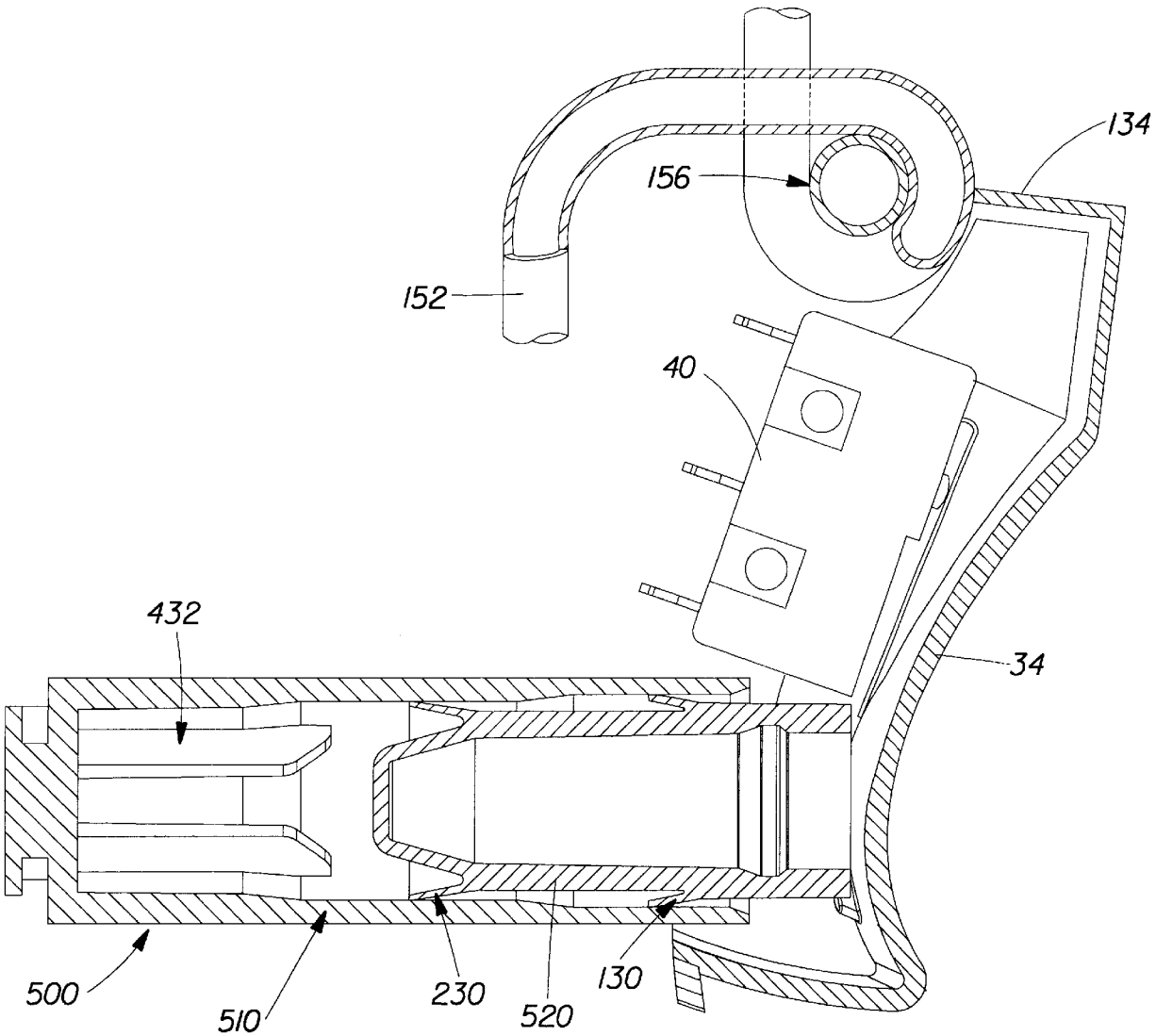
FIG. 15 is a cross-sectional side view of the venting mechanism in the second position with the trigger, the switch is closed, the vent tube and the "pinched tube" mechanism where the vent tube is not squeezed and where the compression spring has been removed for clarity.
Figures 16, 16A:
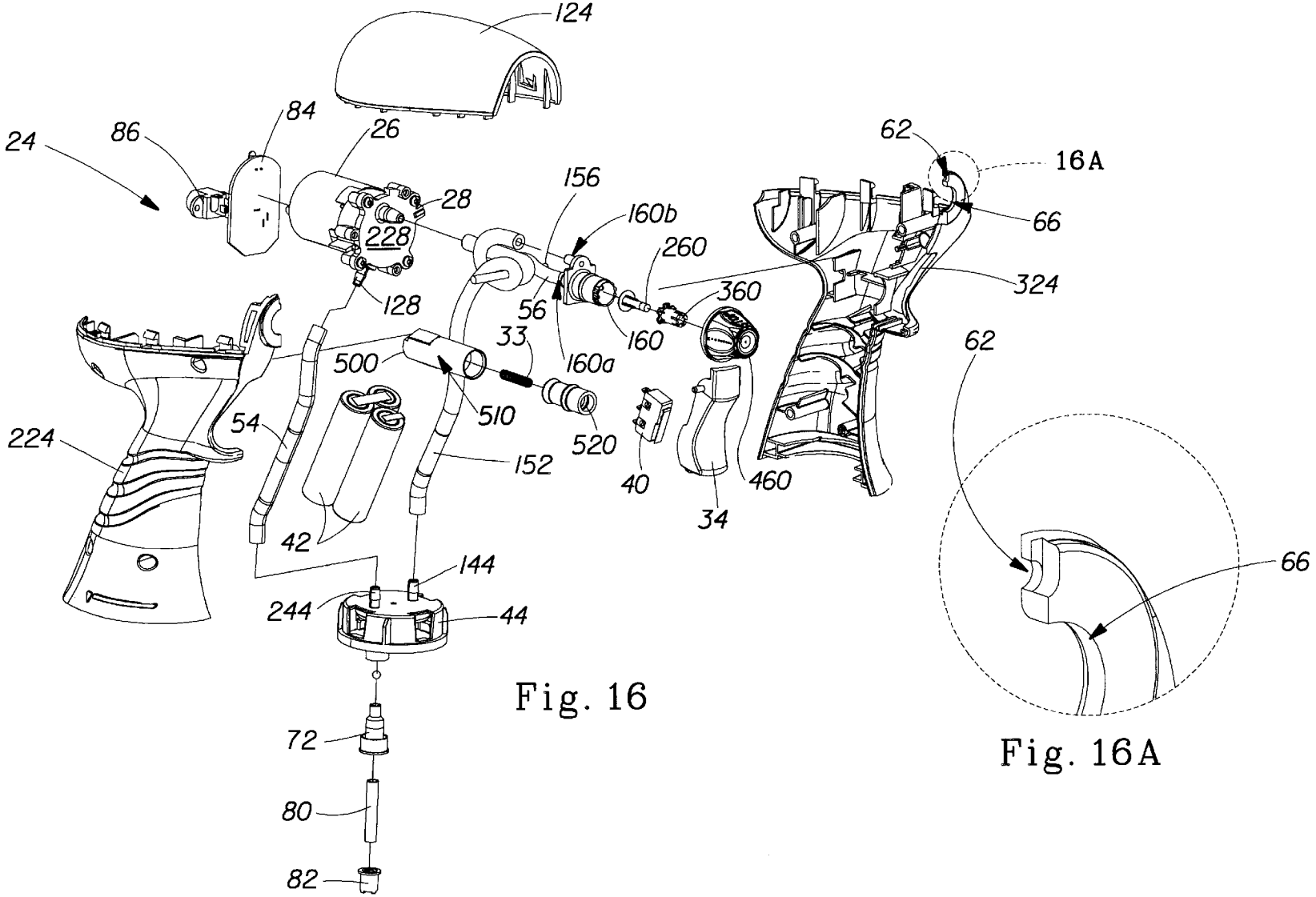
FIG. 16 is an exploded view of a liquid sprayer made in accordance with another embodiment of the present invention but omitting the bottle for clarity and where the pinched tube mechanism is used for both the discharge tube and the vent tube.
FIG. 16*a* is a fragmentary enlargement of FIG. 16 showing the semi-circular openings on the lower housing.
Figure 17:
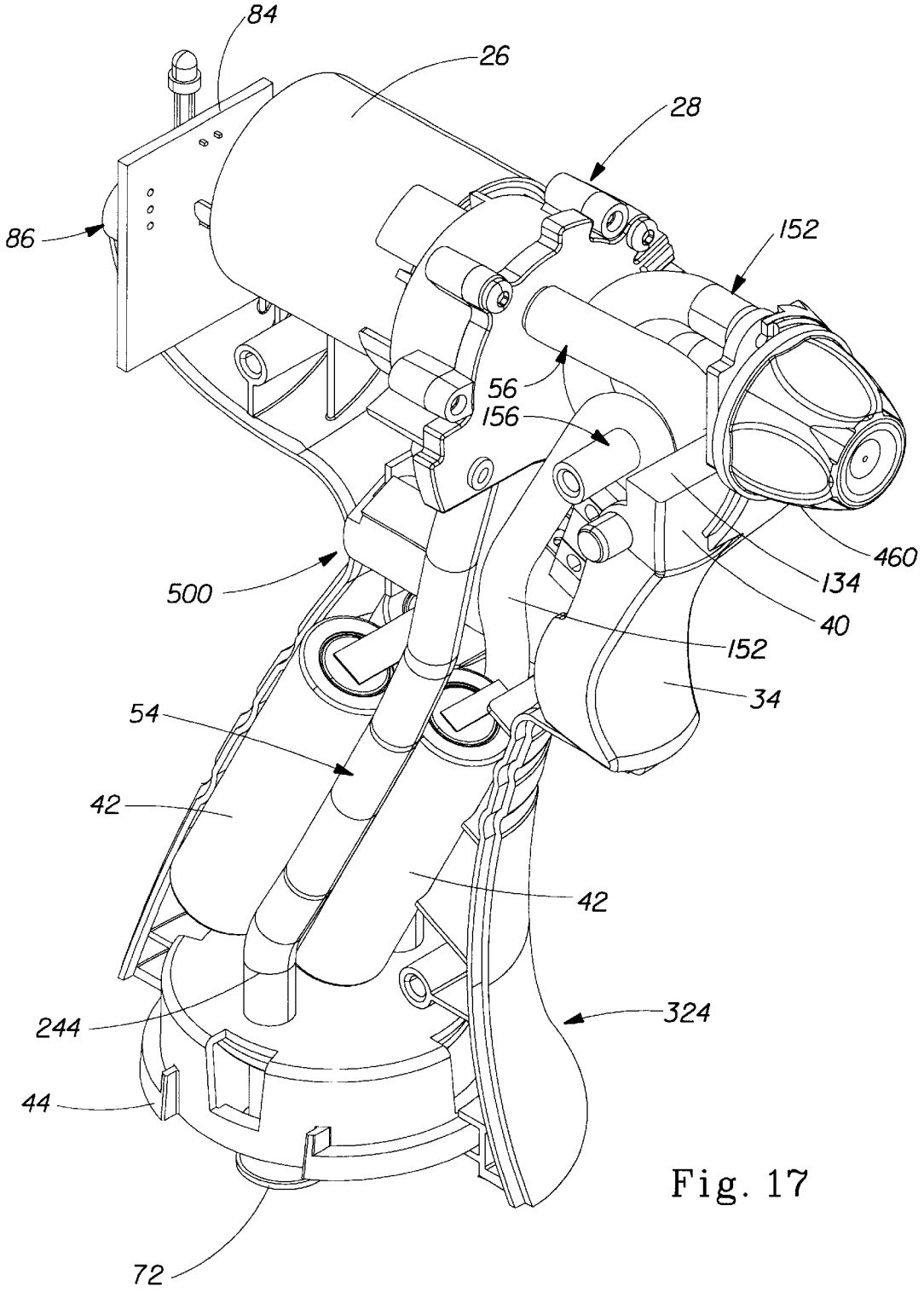
FIG. 17 is a perspective view of the sprayer head assembled without the upper shell and one of the lower housing made in accordance with one embodiment of the present invention according to FIG. 16.

As shown in FIGS. 14 and 15, a first position of a biasing mechanism 500 prevents venting from occurring (shown in FIG. 14) and a second position of the biasing mechanism 500 enables venting in the bottle (shown in FIG. 15). The biasing mechanism 500 comprises a housing 510, a translating piston 520 slidably disposed within the housing 510 and a compression spring 33 biasing the vent piston in the direction of a trigger 34. In one embodiment of the invention, the compression spring is kept centered in the vent housing by fins 432 extending from the closed end of the vent housing towards its opened end. The trigger 34 is movably attached to left and right housings 224 and 324 when the liquid sprayer is assembled. When actuated by a user, the trigger 34 translates the translating piston within the housing 510 and closes the switch 40. Preferably, the translating piston and switch are arranged so that the translating piston 510 begins to translate before the trigger 34 closes the switch 40. When closed by the trigger, the switch 40 completes an electrical circuit between a portable voltage source, illustrated as a plurality of batteries 42, and the electrical motor 26 and thereby activates the gear pump 28. One skilled in the art will understand that other voltage source may be used and still provide the same benefits. For example, a single battery unit might be used. The electrical motor of the sprayer may also be connected to the electric plug of a wall with a proper voltage transformer and electric cable.

In one embodiment of the invention, at least one portion of the trigger 34, preferably the upper portion 134 of the trigger 34, compresses a portion of the vent tube 152 against the pole member 156 such that liquid is prevented from flowing through the vent aperture 160*b* in the event the sprayer is accidentally tilted from its upright position. The biasing action of the spring 33 on the translating piston 30 and trigger 34 generates the compression of the upper portion 134 of the trigger 34 against the portion of the vent tube 152. This arrangement is schematically represented in FIG. 14. When the user actuates the trigger 34, the spring 33 is compressed and the pressure on the discharge tube 56 and vent tube 152 is released. Consequently, ambient air can flow in the vent tube 152 from the venting aperture 160*b* to the bottle. This arrangment is schematically represented in FIG. 15. When the user completely releases pressure on the trigger 34, the "pinched tube" mechanism comes back to the position shown in FIG. 14. The spring 33 biases the translating piston 30 and the trigger 34. As a result, the upper portion 134 of the trigger 34 compresses a portion of the vent tube 152 which in turn, sealingly prevents liquid from flowing through the venting aperture 160*b*.

Referring to FIG. 16 through FIG. 19 and in accordance with one aspect of the present invention, another embodiment of the invention is represented.

In this embodiment of the invention, the "pinched tube" mechanism is used for both the discharge tube 56 and the vent tube 152. In one embodiment, represented in FIG. 16 and FIG. 17, the pump discharge tube 56 interconnects the pump outlet 228 with a nozzle adapter 160 through a first passage 160*a* and a vent tube 152 is connected to an opening of the housing of the sprayer head and extends towards the opening of the bottle. Preferably, this vent tube 152 is secured to the vent aperture 160*b* disposed on the nozzle adapter 160, wherein the vent aperture 160*b* is exposed to the ambient environment through semicircular cut-outs 62 in each of the housings 224 and 324, shown in FIG. 16A. In a preferred embodiment of the invention, the other end of the vent tube 152 is secured to the first through passage 144 of the fitment 44. In this embodiment, both the discharge tube 56 and vent tube 152 are flexible enough to be optionally but preferably bent in order to be angled and to be applied against the pole member 156. In a preferred embodiment of the invention, the pole member 156 serves as a mandrel and both the pump discharge tube 56 and the vent tube 152 are bent in order to form at least one loop around the pole member 156. The discharge tube 56 and vent tube 152 are also deformable such that when there are radially subjected to pressure or "pinched", at least a portion of both the discharge tube 56 and the vent tube 152 collapses in order to create a leak tight seal preventing a liquid from flowing towards the nozzle aperture 160*a* and vent aperture 160*b*, but they return to their original shape when pressure is released and thus allows liquid to flow to the nozzle mechanism and air to flow through the tube which in turn, enables venting of the bottle.

Figure 18:
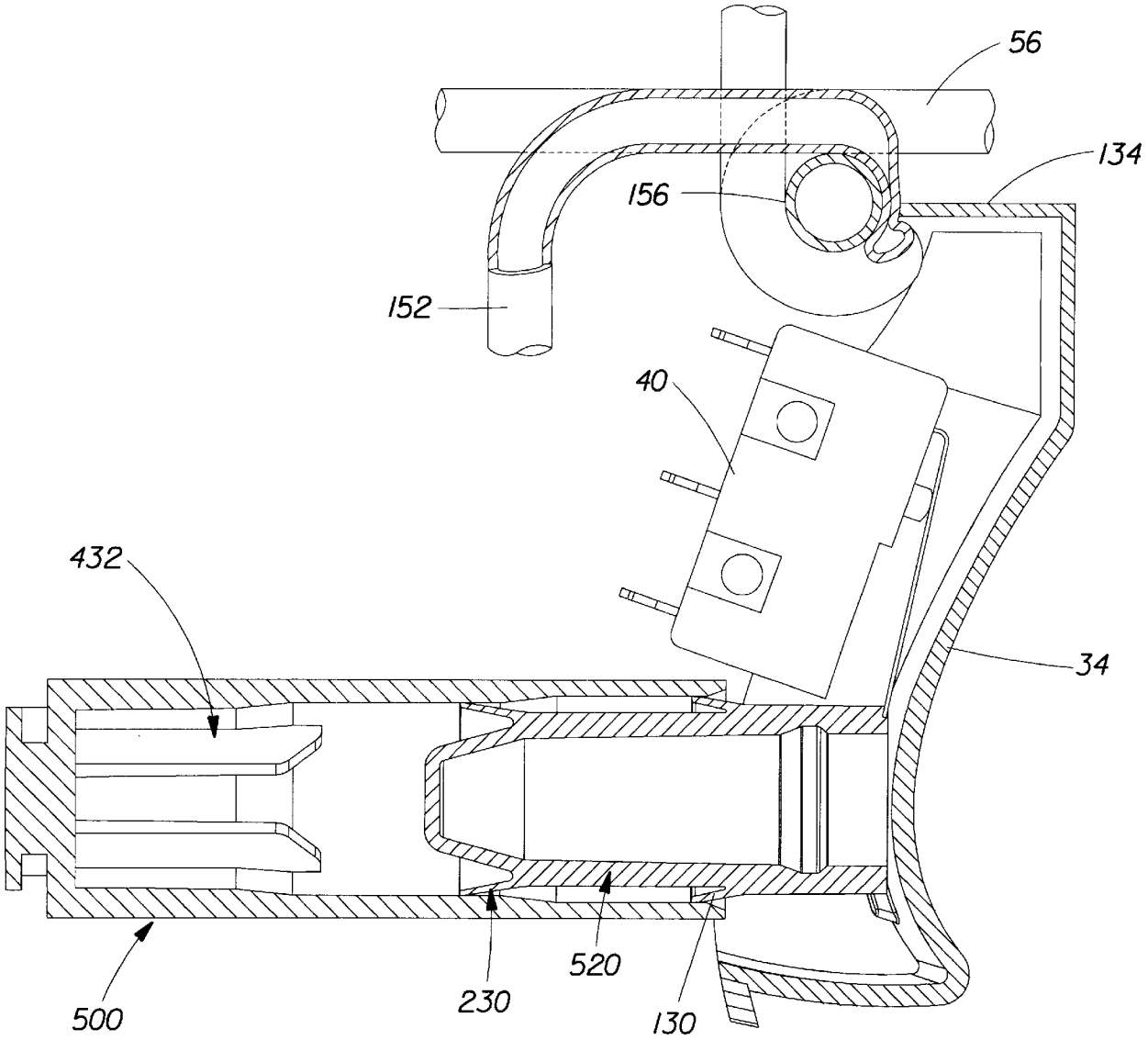
FIG. 18 is a cross-sectional side view of the venting mechanism in the first position with the trigger, the switch and the "pinched tube" mechanism used for both the discharged tube and the vent tube, where the pump discharge tube and the vent tube are squeezed by the trigger; the compression spring is omitted for clarity.
Figure 19:
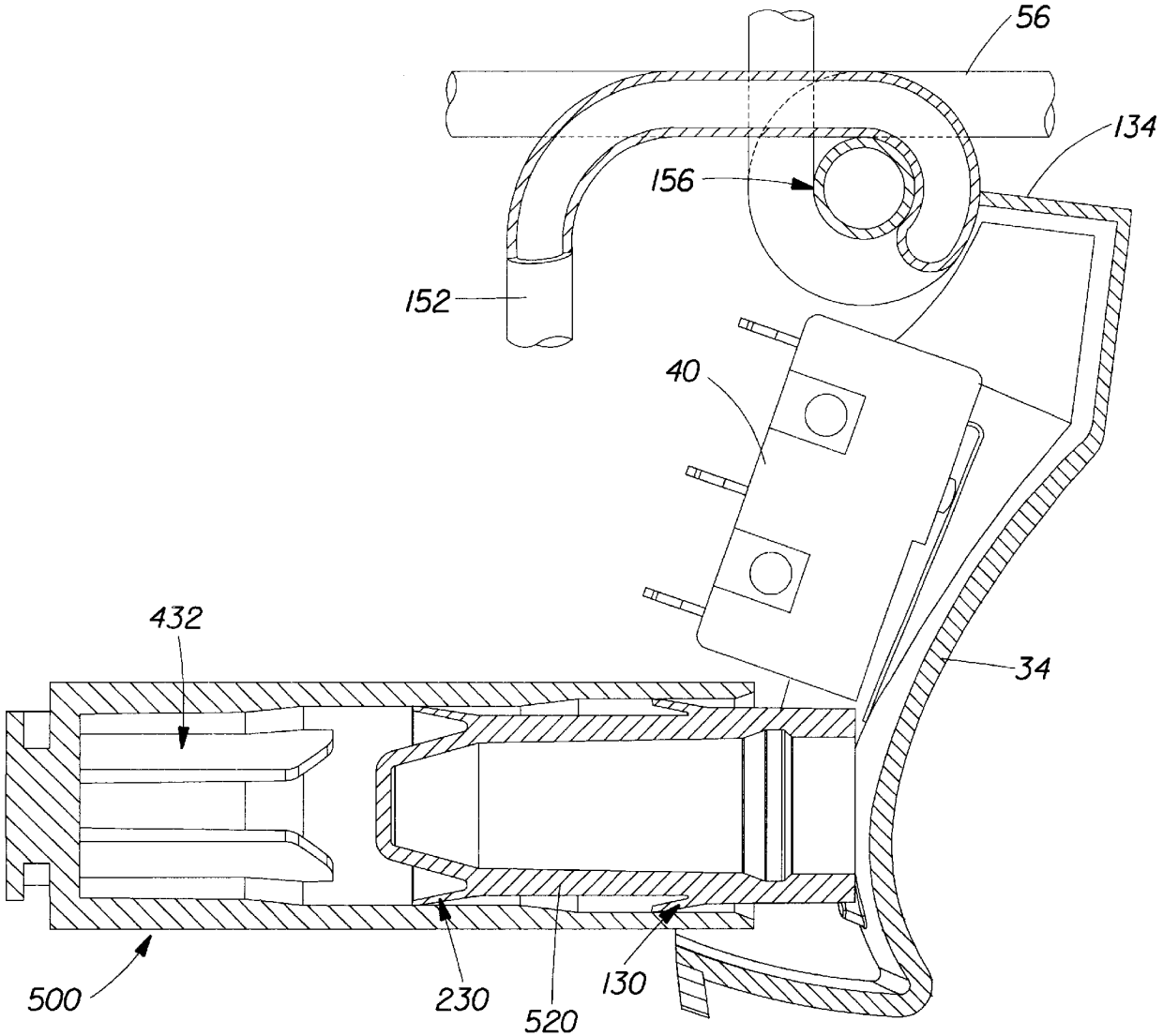
FIG. 19 is a cross-sectional side view of the venting mechanism in the second position with the trigger, the switch is closed, the vent tube and the "pinched tube" mechanism where the pump discharged tube and the vent tube are not squeezed and where the compression spring has been removed for clarity.

As shown in FIGS. 18 and 19, a first position of a biasing mechanism 500 prevents liquid from flowing to the nozzle aperture and also prevents venting from occurring (shown in FIG. 18). A second position of the biasing mechanism 500 allows liquid to flow to the nozzle aperture 160*a* and enables venting in the bottle (shown in FIG. 19). The biasing mechanism 500 comprises a housing 510, a translating piston 520 slidably disposed within the housing 510 and a compression spring 33 biasing the vent piston in the direction of a trigger 34. In one embodiment of the invention, the compression spring is kept centered in the vent housing by fins 432 extending from the closed end of the vent housing towards its opened end. The trigger 34 is movably attached to left and right housings 224 and 324 when the liquid sprayer is assembled. The trigger 34 translates the translating piston within the housing 510 and closes the switch 40. Preferably, the translating piston and switch are arranged so that the translating piston 520 begins to translate before the trigger 34 closes the switch 40. When closed by the trigger, the switch 40 completes an electrical circuit between a portable voltage source, illustrated as a plurality of batteries 42, and the electrical motor 26 and thereby activates the gear pump 28.

In one embodiment of the invention, at least one portion of the trigger 34, preferably the upper portion 134 of the trigger 34, compresses a portion of the discharge tube 56 and at least a portion of the vent tube 152 against the pole member 156 such that liquid is prevented from flowing through the nozzle mechanism 60 and through the vent aperture 160*b*. The biasing action of the spring 33 on the translating piston 30 and trigger 34 generates the compression of the upper portion 134 of the trigger 34 against the portions of the discharge tube 56 and vent tube 152. This arrangement is schematically represented in FIG. 18. When the user actuates the trigger 34, the spring 33 is compressed and the pressure on the discharge tube 56 and vent tube 152 is released. Consequently, liquid can flow in the discharge tube 56 to the nozzle mechanism 60 and ambient air can flow in the vent tube 152 from the venting aperture 160*b* to the bottle. This arrangment is schematically represented in FIG. 19. When the user releases pressure on the trigger 34, the spring 33 biases the translating piston 30 and the trigger 34. As a result, the upper portion 134 of the trigger 34 compresses a portion of the discharge tube 56 and vent tube 152 which in turn, sealingly prevents liquid from flowing through the nozzle aperture 160*a* and venting aperture 160*b*.

One skilled in the art will understand that other biasing mechanisms may be used and still provide the same benefits. For example, any type of spring like mechanism or deformable and elastic piece of material such as elastomer or the like can be used. Preferably, the biasing mechanism is easily deformable when a user manually actuates the trigger but it has sufficient "strength" to put the trigger back to its original position and impart enough pressure to both the discharge tube 56 and vent tube 152 such that a leak tight seal is generated.

One skilled in the art will also understand that the pinched tube mechanism used with the vent tube is particularly beneficial which prevents a liquid from siginificantly exiting the bottle through the vent apererture 160*b*. Since it renders optional, the use of the first check valve 74 which is connected to the first through passage 144, prevents a liquid from significantly exiting the bottle through the vent 160*b* when the bottle is in a substantially downward position.

The foregoing description of the preferred embodiments of the invention have been presented for purposes of illustration and description. It is not intended to be exhaustive or to limit the invention to the precise form disclosed. Modifications or variations are possible and contemplated in light of the above teachings by those skilled in the art, and the embodiments discussed were chosen and described in order to best illustrate the principles of the invention and its practical application. It is intended that the scope of the invention be defined by the claims appended hereto.

What is claimed is:

1. A trigger-activated mechanism for dispensing a fluid, comprising:

a) a fluid pump mechanism having an inlet for receiving a fluid and an outlet for expressing said fluid;

b) a dip tube extending from said inlet and providing communication for said fluid between said pump mechanism and a reservoir for said fluid;

c) a discharge tube extending from said outlet, said discharge tube having at least one resilient, collapsible portion, said discharge tube providing communication for said fluid between said pump mechanism and a discharge outlet from said trigger-activated mechanism;

d) a pole member fixedly positioned between said pump mechanism outlet and said discharge outlet in proximity to said resilient collapsible segment of said discharge tube wherein said pole member serves as a mandrel and a portion of said resilient, collapsible segment of said discharge tube is loaned around said pole member; and e) an actuating trigger mounted in communication with said trigger-activated mechanism and having a distal side for compressive engagement by a user of said trigger-activated mechanism and a proximal side facing said pole member and said discharge tube, said proximal side comprising means for collapsing said resilient collapsible segment of said discharge tube against said pole member such that a fluid cannot flow in said discharge tube when said trigger is not compressively engaged and such that a fluid can flow in said discharge tube when said trigger is compressively engaged.

2. A mechanism according to claim 1 wherein the proximal side of said trigger comprises one or more protuberances extending outwardly therefrom which compressively engage and collapse said resilient, collapsible segment of said discharge tube against said pole member when said trigger is not being compressively engaged.

3. A mechanism according to claim 1 wherein said discharge outlet is a spray nozzle.

4. A mechanism according to claim 1 wherein said fluid pump mechanism comprises a switch engageable by said trigger, a portable voltage source, a gear-pump driven by an electrical motor powered by said portable voltage source when said switch is closed, whereby said electrical motor, said portable voltage source and said switch form an electrical circuit.

5. A mechanism according to claim 1 wherein said trigger-activated mechanism is removably attached to said reservoir filled with a liquid.

6. A mechanism according to claim 5 wherein said liquid is a chemically aggressive liquid composition.

7. A mechanism according to claim 6, wherein said fluid pump mechanism comprises a switch engageable by said trigger, a portable voltage source, a gear-pump driven by an electrical motor powered by said portable voltage source when said switch is closed, whereby said electrical motor, said portable voltage source and said switch form an electrical circuit.

8. A trigger-vented mechanism for venting a container of a trigger-activated mechanism used for dispensing a fluid, comprising:

a. a housing having one opening and comprising a fluid pump mechanism having an inlet in fluid communication with a container filled with a fluid and an outlet in fluid communication with a discharge outlet for dispensing said fluid, b. a vent tube extending from said container to said opening and providing air communication between said container and said opening, said vent tube having at least one resilient, collapsible portion;

c. a pole member fixedly positioned between said container and said opening in proximity to said resilient collapsible segment of said vent tube; and d. an actuating trigger mounted in communication with said trigger-activated mechanism and having a distal side for compressive engagement by a user of said trigger-activated mechanism and a proximal side facing said pole member and said vent tube, said proximal side comprising means for collapsing said resilient collapsible segment of said vent tube against said pole member such that a fluid cannot flow in said vent tube when said trigger is not compressively engaged and such that a fluid can flow in said vent tube when said trigger is compressively engaged.

9. The trigger-vented mechanism of claim 8 wherein said pole member serves as a mandrel and a portion of said resilient, collapsible segment of said vent tube is looped around said pole member.

10. The trigger-vented mechanism of claim 8 wherein the proximal side of said trigger comprises one or more protuberances extending outwardly therefrom which compressively engage and collapse said resilient, collapsible segment of said vent tube against said pole member when said trigger is not being compressively engaged.

11. The trigger-vented mechanism of claim 8 wherein said discharge outlet is a spray nozzle.

12. The trigger-vented mechanism of claim 8 wherein said fluid pump mechanism comprises a switch engageable by said trigger, a portable voltage source, a gear-pump driven by an electrical motor powered by said portable voltage source when said switch is closed, whereby said electrical motor, said portable voltage source and said switch form an electrical circuit.

13. A trigger-vented/activated mechanism for dispensing a fluid and for venting a container of a trigger-activated mechanism used for dispensing a fluid, comprising:

a) a housing having one opening and comprising a fluid pump mechanism having an inlet for receiving a fluid from a fluid filled container and an outlet in fluid communication with a discharge outlet for expressing said fluid;

b) a dip tube extending from said inlet and providing communication for said fluid between said pump mechanism and a reservoir for said fluid;

c) a discharge tube extending from said outlet, said discharge tube having at least one resilient, collapsible portion, said discharge tube providing communication for said fluid between said pump mechanism and a discharge outlet from said trigger-vented/activated mechanism d) a vent tube extending from said container to said opening and providing air communication between said container and said opening, said discharge tube having at least one resilient, collapsible portion;

e) a pole member fixedly positioned between said pump mechanism outlet and said discharge outlet in proximity to said resilient collapsible segment of said discharge tube and said resilient collapsible segment of said vent tube; and f) an actuating trigger mounted in communication with said trigger-vented/activated mechanism and having a distal side for compressive engagement by a user of said trigger-vented/activated mechanism and a proximal side facing said pole member, said discharge tube and said vent tube, said proximal side comprising means for collapsing said resilient collapsible segment of both said discharge and vent tube against said pole member such that a fluid cannot flow in said discharge and vent tube when said trigger is not compressively engaged and such that a fluid can flow in said discharge and vent tube when said trigger is compressively engaged.

14. The trigger-vented mechanism of claim 13 wherein said pole member serves as a mandrel and a portion of said resilient, collapsible segment of both said discharge and vent tube is looped around said pole member.

15. The trigger-vented mechanism of claim 13 wherein the proximal side of said trigger comprises one or more protuberances extending outwardly therefrom which compressively engage and collapse said resilient, collapsible segment of both said discharge and vent tube against said pole member when said trigger is not being compressively engaged.

16. The trigger-vented mechanism of claim 13 wherein said discharge outlet is a spray nozzle.

17. The trigger-vented mechanism of claim 13, wherein said fluid pump mechanism comprises a switch engageable by said trigger, a portable voltage source, a gear-pump driven by an electrical motor powered by said portable voltage source when said switch is closed, whereby said electrical motor, said portable voltage source and said switch form an electrical circuit.

* * * * *